US010895816B2

(12) United States Patent
Masuda et al.

(10) Patent No.: US 10,895,816 B2
(45) Date of Patent: Jan. 19, 2021

(54) IMAGE FORMING APPARATUS AND TONER SET

(71) Applicants: Minoru Masuda, Shizuoka (JP); Hiroshi Yamashita, Shizuoka (JP); Ryota Inoue, Shizuoka (JP); Yuka Mizoguchi, Shizuoka (JP); Daichi Hisakuni, Shizuoka (JP); Tomomi Harashima, Shizuoka (JP)

(72) Inventors: Minoru Masuda, Shizuoka (JP); Hiroshi Yamashita, Shizuoka (JP); Ryota Inoue, Shizuoka (JP); Yuka Mizoguchi, Shizuoka (JP); Daichi Hisakuni, Shizuoka (JP); Tomomi Harashima, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/569,279

(22) Filed: Sep. 12, 2019

(65) Prior Publication Data

US 2020/0089140 A1 Mar. 19, 2020

(30) Foreign Application Priority Data

Sep. 13, 2018 (JP) ..... 2018-171446
Jul. 11, 2019 (JP) ..... 2019-128984

(51) Int. Cl.
*G03G 9/00* (2006.01)
*G03G 9/09* (2006.01)
(Continued)

(52) U.S. Cl.
CPC ..... *G03G 9/0926* (2013.01); *G03G 9/0823* (2013.01); *G03G 9/08755* (2013.01);
(Continued)

(58) Field of Classification Search
CPC ..... G03G 9/0926; G03G 9/09
(Continued)

(56) References Cited

U.S. PATENT DOCUMENTS

2006/0008721 A1 1/2006 Hirai
2016/0202622 A1 7/2016 Hirai et al.
(Continued)

FOREIGN PATENT DOCUMENTS

JP 2012-032765 2/2012
JP 2016-139053 8/2016
(Continued)

OTHER PUBLICATIONS

Extended European Search Report dated Jan. 20, 2020, in Patent Application No. 19197095.3.
(Continued)

*Primary Examiner* — Mark A Chapman
(74) *Attorney, Agent, or Firm* — Oblon, McClelland, Maier & Neustadt, L.L.P.

(57) ABSTRACT

An image forming apparatus is provided that includes: first and second electrostatic latent image bearers; first and second electrostatic latent image forming devices; first and second developing devices configured to develop first and second electrostatic latent images with a colored toner and a special-color toner to form a colored toner image and a special-color toner image, respectively; a primary transfer device configured to transfer the colored toner image and the special-color toner image onto an intermediate image bearer in an overlapping manner to form a composite toner image; a secondary transfer device configured to transfer the composite toner image onto a recording medium; and a fixing device configured to fix the composite toner image thereon. The special-color toner comprises plate-like and/or film-like pigments. An absolute difference in volume resistivity
(Continued)

between the special-color toner and the colored toner is 0.30 log Ω cm or less.

16 Claims, 6 Drawing Sheets

(51) Int. Cl.
*G03G 9/08* (2006.01)
*G03G 9/087* (2006.01)
*G03G 15/01* (2006.01)

(52) U.S. Cl.
CPC ..... *G03G 9/08782* (2013.01); *G03G 9/09* (2013.01); *G03G 9/091* (2013.01); *G03G 9/0902* (2013.01); *G03G 9/0904* (2013.01); *G03G 9/0906* (2013.01); *G03G 9/0918* (2013.01); *G03G 15/0126* (2013.01); *G03G 15/0131* (2013.01)

(58) Field of Classification Search
USPC ..... 430/107.1, 111.4
See application file for complete search history.

(56) References Cited

U.S. PATENT DOCUMENTS

| | | | | |
|---|---|---|---|---|
| 2017/0285518 | A1 | 10/2017 | Hara et al. | |
| 2018/0267417 | A1 | 9/2018 | Mizoguchi et al. | |
| 2018/0267420 | A1 | 9/2018 | Yamashita et al. | |
| 2018/0364600 | A1 | 12/2018 | Fuwa et al. | |
| 2019/0094787 | A1* | 3/2019 | Anno ..... | G03G 21/0047 |
| 2019/0235405 | A1 | 8/2019 | Masuda et al. | |

FOREIGN PATENT DOCUMENTS

| | | |
|---|---|---|
| JP | 2017-181643 | 10/2017 |
| JP | 2018-155828 | 10/2018 |
| WO | WO99/054074 A1 | 10/1999 |

OTHER PUBLICATIONS

Junius David Edwards, "Aluminum Paint and Powder" Reinhold Publishing Corporation, 1936. 214 pages.
JIS (Japanese Industrial Standards) K 5906-1998, "Aluminum pigments for paints", p. 7-p. 10. 5 pages (with English Translation).

* cited by examiner

CIRCUMFERENTIAL LENGTH: C1
PROJECTED AREA: S

CIRCLE HAVING AREA S
CIRCUMFERENTIAL LENGTH: C2

IMAGE FORMING APPARATUS AND TONER SET

CROSS-REFERENCE TO RELATED APPLICATIONS

This patent application is based on and claims priority pursuant to 35 U.S.C. § 119(a) to Japanese Patent Application Nos. 2018-171446 and 2019-128984, filed on Sep. 13, 2018 and Jul. 11, 2019, respectively, in the Japan Patent Office, the entire disclosure of each of which is hereby incorporated by reference herein.

BACKGROUND

Technical Field

The present disclosure relates to an image forming apparatus and a toner set.

Description of the Related Art

As electrophotographic color image forming apparatuses have been widely spread, their applications have been diversified. There is a demand for metallic-tone image in addition to conventional color image.

What is called a glittering toner that contains a metallic pigment in a binder resin has been used to form an image having glittering texture like metal.

Such an image with metallic luster should exhibit strong light reflectivity when viewed from a certain angle. To achieve this, a highly-reflective pigment ("glittering pigment") having a scale-like plane is generally blended in the glittering toner.

Suitable examples of the highly-reflective pigment include metals and metal-coated pigments. For securing reliable reflectivity, each pigment particle has a plane with a certain degree of area so that pigment particles are arranged in a planer form in a fixed toner image.

SUMMARY

In accordance with some embodiments of the present invention, an image forming apparatus is provided. The image forming apparatus includes: a first electrostatic latent image bearer configured to bear a colored toner image; a first electrostatic latent image forming device configured to form a first electrostatic latent image on the first electrostatic latent image bearer; a first developing device containing a colored toner, configured to develop the first electrostatic latent image formed on the first electrostatic latent image bearer with the colored toner to form the colored toner image; a second electrostatic latent image bearer configured to bear a special-color toner image; a second electrostatic latent image forming device configured to form a second electrostatic latent image on the second electrostatic latent image bearer; a second developing device containing a special-color toner, configured to develop the second electrostatic latent image formed on the second electrostatic latent image bearer with the special-color toner to form the special-color toner image; a primary transfer device configured to transfer the colored toner image and the special-color toner image onto a surface of an intermediate image bearer in an overlapping manner to form a composite toner image; a secondary transfer device configured to transfer the composite toner image from the intermediate image bearer onto a surface of a recording medium; and a fixing device configured to fix the composite toner image on the surface of the recording medium. The special-color toner comprises at least one of a plate-like pigment and a film-like pigment. An absolute difference in volume resistivity between the special-color toner and the colored toner is 0.30 log Ωcm or less.

In accordance with some embodiments of the present invention, a toner set is provided. The toner set includes a colored toner and a special-color toner. The special-color toner comprises at least one of a plate-like pigment and a film-like pigment. An absolute difference in volume resistivity between the special-color toner and the colored toner is 0.30 log Ω cm or less.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
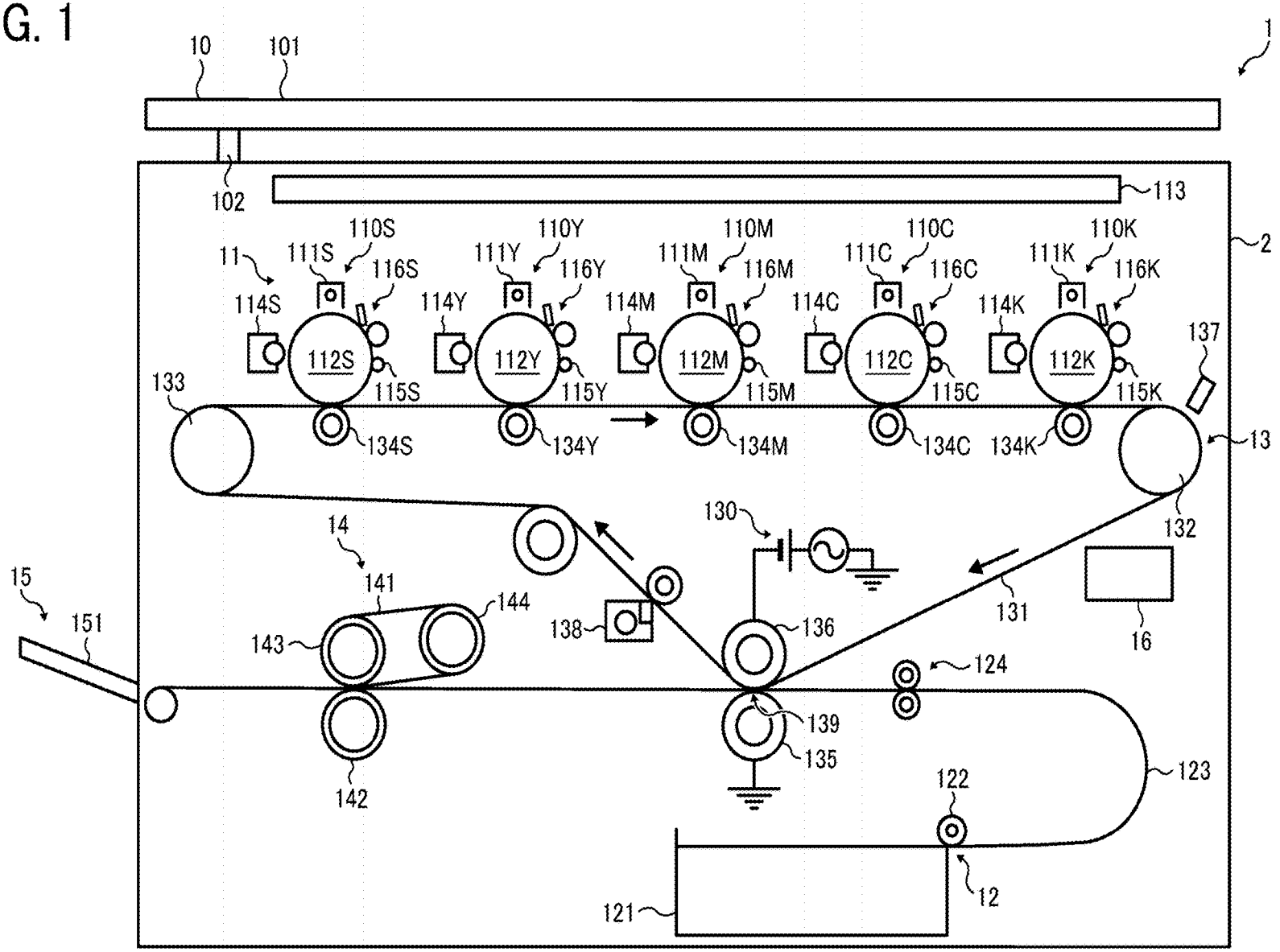
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

An embodiment of the present invention provides an image forming apparatus capable of forming a high-definition high-quality full-color image including glittering colors, by bringing the electrical resistivity of a special-color toner having glittering property close to that of a colored toner, while securing glittering property of the image.

JP-5365648-B (corresponding to JP-2012-32765-A) discloses a toner in which glittering pigment particles are oriented in one direction. The thickness of the toner is adjusted to be greater than the equivalent circle diameter of the toner, so that the glittering pigment particles can be arranged in a planar form in an image formed with the toner in the developing and transferring processes.

JP-2016-139053-A discloses a toner particle containing a binder resin and 3.5 or more flat particles of a glittering pigment, in which the multiple flat particles of the glittering pigment are oriented in the same direction.

Conventionally, it has been considered that a glittering toner image is achieved when the planes of the glittering pigment particles are aligned at the surface of the image and light is effectively reflected by the planes. Thus, it has been believed that plate-like pigment particles are preferably oriented in one direction inside the toner.

In the toner disclosed in JP-5365648-B (corresponding to JP-2012-32765-A) or JP-2016-139053-A, the average particle diameter of the toner is adjusted to be greater than the thickness of the toner. When multiple pigment particles in a flat shape are dispersed orienting in one direction in such a thin toner particle, the flat pigment particles are stacked on each other with a narrow gap therebetween.

When glittering pigment particles are dispersed in a toner in a stacking manner with a narrow gap therebetween, electrical resistivity of the toner will deteriorate that leads to easy formation of electrical conduction path. This is because most glittering pigment particles are made of or coated with a metal. In this case, charge retention property at the surface of the toner decreases, resulting in deterioration of chargeability of the toner.

Special-color toners having glittering property, such as gold toner and silver toner, contain glittering pigments. The glittering pigment is a plate-like piece of metal having a certain size for efficiently reflecting light, which has electroconductivity. Therefore, the special-color toner tends to have a smaller electrical resistivity than other colored toners.

When the electrical resistivity of the special-color toner is low, it is difficult to retain the surface charge of the special-color toner, which causes a problem. In particular, the inventors of the present invention have found that charge injection occurs during the primary transfer and the secondary transfer to cause reverse transfer and defective transfer, resulting in reduction of the total transfer rate of the special-color toner.

In addition, it has been found that, in the case of forming a full-color image by combining such a special-color toner having glittering property with a colored toner such as a process color toner, transferability is poor. Specifically, the inventors of the present invention have found that, since the electrical resistivity of the conventional special-color toner is different from that of the colored toner, the special-color toner tends to remain without being transferred in a large amount, resulting in a low transfer rate and the occurrence of transfer unevenness.

Therefore, it has not been sufficient to simply combine the conventional special-color color toners with colored toners, for providing an image forming apparatus capable of forming a high-definition high-quality full-color image including glittering colors by bringing the electrical resistivity of a special-color toner having glittering property close to that of a colored toner while securing glittering property of the image.

As a result of intensive studies, the inventors of the present invention have achieved a special-color toner that contains a glittering pigment comprised of a plate-like pigment and/or a film-like pigment and has a volume resistivity close to that of a colored toner. Further, the inventors of the present invention have achieved an image forming apparatus that forms a full-color image by superimposing a colored toner image and a special-color toner image. The image forming apparatus uses a toner set of a special-color toner and a colored toner with a specific difference in volume resistivity therebetween, and is capable of forming a high-definition high-quality full-color image including glittering colors while securing glittering property of the image.

Thus, the image forming apparatus according to an embodiment of the present invention is capable of forming a high-definition high-quality full-color image including glittering colors, by bringing the electrical resistivity of a special-color toner having glittering property close to that of a colored toner, while securing glittering property of the image.

Image Forming Apparatus

An image forming apparatus according to an embodiment of the present invention includes: a first electrostatic latent image bearer configured to bear a colored toner image; a first electrostatic latent image forming device configured to form a first electrostatic latent image on the first electrostatic latent image bearer; a first developing device containing a colored toner, configured to develop the first electrostatic latent image formed on the first electrostatic latent image bearer with the colored toner to form the colored toner image; a second electrostatic latent image bearer configured to bear a special-color toner image; a second electrostatic latent image forming device configured to form a second electrostatic latent image on the second electrostatic latent image bearer; a second developing device containing a special-color toner, configured to develop the second electrostatic latent image formed on the second electrostatic latent image bearer with the special-color toner to form the special-color toner image; a primary transfer device configured to transfer the colored toner image and the special-color toner image onto a surface of an intermediate image bearer in an overlapping manner to form a composite toner image; a secondary transfer device configured to transfer the composite toner image from the intermediate image bearer onto a surface of a recording medium; and a fixing device configured to fix the composite toner image on the surface of the recording medium. The special-color toner comprises at least one of a plate-like pigment and a film-like pigment. The absolute difference in volume resistivity between the special-color toner and the colored toner is 0.30 log Ωcm or less.

Preferably, the absolute difference in volume resistivity between the special-color toner and the colored toner is 0.20 log Ω cm or less.

The image forming apparatus according to an embodiment of the present invention is described below with reference to FIG. 1.

Hereinafter, embodiments of the present invention are described in detail with reference to the drawings.

FIG. 1 is a schematic view of an image forming apparatus according to an embodiment of the present invention.

An image forming apparatus 1 illustrated in FIG. 1 is a color-image forming apparatus including a tandem image forming unit (also referred to as a process cartridge) that forms a color image. Specifically, the image forming apparatus 1 includes an image reader 10, an image forming device 11, a sheet feeder 12, a transfer device 13, a fixing device 14, a sheet ejector 15, and a processor 16.

Image Reader 10

The image reader 10 reads an image of a document and generates image information. The image reader 10 includes a contact glass 101 and a reading sensor 102. The image reader 10 emits light to the document and receives the reflected light by a sensor such as a charge-coupled device (CCD) and a contact image sensor (CIS) to read electric color separation signals for three primary colors RGB of light.

Image Forming Device 11

The image forming device 11 includes five image forming units 110S, 110Y, 110M, 110C, and 110K that form and output toner images of special color (S) having glittering property such as gold and silver, yellow (Y), magenta (M), cyan (C), and black (K), respectively.

The five image forming units 110S, 110Y, 110M, 110C, and 110K have the same configuration except for containing different color toners of S, Y, M, C, and K, respectively, as image forming materials, and are replaceable when their lifespans are over. The image forming units 110S, 110Y, 110M, 110C, and 110K are detachably attached to an apparatus body 2 and constitute a process cartridge. Hereinafter, the common configuration is described with the image forming unit 110K for forming a K toner image as an example.

The image forming unit 110K includes a charging device 111K, a photoconductor 112K as a K toner image bearer for bearing a K toner image on the surface thereof, a developing device 114K, a charge removing device 115K, and a photoconductor cleaning device 116K. These devices are held by a common holder that is detachably attached to the apparatus body 2, so that these devices are replaceable at the same time.

The photoconductor 112K has a drum-like shape and includes a substrate and an organic photosensitive layer formed on the surface of the substrate. The photoconductor 112K is rotationally driven counterclockwise by a driver. In the charging device 111K, a charger applies a charging bias to a charging wire that is a charging electrode of the charger to generate an electrical discharge between the charging wire and the outer circumferential surface of the photoconductor 112K, thus uniformly charging the surface of the photoconductor 112K. In the present embodiment, the photoconductor 112K is charged to the negative polarity that is the same as the charging polarity of the toner. The charging bias employed in the present embodiment is one in which an alternating current voltage is superimposed on a direct current voltage. In place of the charger, a charging roller may be disposed in contact with or in proximity to the photoconductor 112K.

The uniformly-charged surface of the photoconductor 112K is then optically scanned by laser light emitted from an exposure device 113, to be described later, thus forming an electrostatic latent image for K. Of the entire area of the uniformly-charged surface of the photoconductor 112K, the potential is attenuated at the portion irradiated with the laser light. Thus, the portion irradiated with the laser light becomes an electrostatic latent image having a potential smaller than the potential at the other portion (background portion). The electrostatic latent image for K is developed into a K toner image by the developing device 114K containing K toner, to be described later. The K toner image is then primarily transferred onto an intermediate transfer belt 131, to be described later.

The developing device 114K includes a container in which a two-component developer containing K toner and a carrier is contained. The container is internally provided with a developing sleeve, and the developer is carried on the surface of the developing sleeve by the magnetic force of a magnet roller provided inside the developing sleeve. The developing sleeve is applied with a developing bias which has the same polarity as the toner and is larger than the potential of the electrostatic latent image on the photoconductor 112K and smaller than the charging potential of the photoconductor 112K. Between the developing sleeve and the electrostatic latent image on the photoconductor 112K, a developing potential acts from the developing sleeve toward the electrostatic latent image. Further, between the developing sleeve and the background portion of the photoconductor 112K, a non-developing potential acts that causes the toner on the developing sleeve to move toward the surface of the sleeve. By the action of the developing potential and the non-developing potential, the K toner on the developing sleeve is selectively attached to the electrostatic latent image on the photoconductor 112K, thereby developing the electrostatic latent image into a K toner image on the photoconductor 112K.

The charge removing device 115K removes the charge on the surface of the photoconductor 112K after the toner image is primarily transferred onto the intermediate transfer belt 131. The photoconductor cleaning device 116K includes a cleaning blade and a cleaning brush and removes residual untransferred toner remaining on the surface of the photoconductor 112K that has been neutralized by the charge removing device 115K.

Referring to FIG. 1, the image forming unit 110S includes a charging device 111S, a photoconductor 112S as a special-color toner image bearer for bearing a special-color toner image on the surface thereof, a developing device 114S, a charge removing device 115S, and a photoconductor cleaning device 116S. The other image forming units 110Y, 110M, and 110C have the same configuration. Therefore, S, Y, M, and C toner images are formed on the respective photoconductors 112S, 112Y, 112M, and 112C in the respective image forming units 110S, 110Y, 110M, and 110C in the same manner as in the image forming unit 110K.

Above the image forming units 110S, 110Y, 110M, 110C, and 110K, the exposure device 113 is disposed as a latent image writing device or an exposure device. The exposure device 113 optically scans the photoconductors 112S, 112Y, 112M, 112C, and 112K with laser light emitted from a laser diode based on image information transmitted from an external device such as the image reader 10 or a personal computer.

The exposure device 113 emits laser light from a light source to the photoconductors 112S, 112Y, 112M, 112C, and 112K via a plurality of optical lenses and mirrors while polarizing the laser light in the main scanning direction by a polygon mirror that is rotationally driven by a polygon motor. In place of the laser light, light emitted from a plurality of light emitting diodes (LEDs) may be employed for optical writing.

Sheet Feeder 12

The sheet feeder 12 supplies a sheet as the recording medium to the transfer device 13. The sheet feeder 12 includes a sheet storage 121, a sheet pickup roller 122, a sheet feeding belt 123, and a registration roller 124. The sheet pickup roller 122 rotates so as to move the sheet stored in the sheet storage 121 toward the sheet feeding belt 123. The sheet pickup roller 122 takes out the sheet on the top of the sheets stored, one by one, and places the sheet on the sheet feeding belt 123. The sheet feeding belt 123 conveys the sheet picked up by the sheet pickup roller 122 to the transfer device 13. The registration roller 124 feeds the sheet to a secondary transfer nip 139, as a transfer nip of the transfer device 13, in synchronization with entry of the portion on the intermediate transfer belt 131 where the toner image is formed to the secondary transfer nip 139.

Transfer Device 13

The transfer device 13 is disposed below the image forming units 110S, 110Y, 110M, 110C, and 110K. The transfer device 13 includes a driving roller 132, a driven roller 133, the intermediate transfer belt 131, primary transfer rollers 134S, 134Y, 134M, 134C, and 134K, a secondary transfer roller 135, a secondary transfer facing roller 136, a toner deposition amount sensor 137, and a belt cleaning device 138.

The intermediate transfer belt 131 functions as an endless intermediate transferor (also referred to as an intermediate image bearer). The intermediate transfer belt 131 is stretched by the driving roller 132, the driven roller 133, the secondary transfer facing roller 136, and the primary transfer rollers 134S, 134Y, 134M, 134C, and 134K, all of which are disposed inside the loop thereof. The term "disposed" is here used to mean "provided with an arrangement" or "provided to a specific position". The term "stretched" is here used to mean "stretched over under tension".

The driving roller 132 is rotationally driven clockwise in FIG. 1 by a driver, so that the intermediate transfer belt 131 endlessly moves and travels in the same direction in contact with the photoconductors 112S, 112Y, 112M, 112C, and 112K.

The intermediate transfer belt 131 has a thickness of from 20 to 200 μm, preferably about 60 μm. The intermediate transfer belt 131 is preferably comprised of a resin dispersing a carbon having a volume resistivity of from $1\times10^{6}$ to $1\times10^{12}$ Ω·cm, preferably about $1\times10^{9}$ Ω·cm, measured by an instrument HIRESTA UPMCPHT 45 available from Mitsubishi Chemical Analytech Co., Ltd. under an applied voltage of 100 V.

The toner deposition amount sensor 137 is disposed in the vicinity of the intermediate transfer belt 131 wound around the driving roller 132. The toner deposition amount sensor 137 functions as a toner amount detector that detects the amount of the toner transferred onto the intermediate transfer belt 131. The toner deposition amount sensor 137 is a light reflection photosensor. The toner deposition amount sensor 137 measures the amount of toner deposition by detecting the amount of light reflected from the toner image (including special-color toner) deposited and formed on the intermediate transfer belt 131. The toner deposition amount sensor 137 may also function as a toner concentration sensor as a conventional toner concentration detector that detects and measures the toner concentration. In such a case, there is no need to provide another toner amount detector, so that the number of parts can be reduced to contribute to cost reduction. Alternatively, the toner deposition amount sensor 137 may be disposed at a position where the toner image on the photoconductor 112 can be detected, in place of the position facing the intermediate transfer belt 131.

The primary transfer rollers 134S, 134Y, 134M, 134C, and 134K are disposed facing the respective photoconductors 112S, 112Y, 112M, 112C, and 112K with the intermediate transfer belt 131 interposed therebetween, and driven to rotate so as to move the intermediate transfer belt 131. As a result, the front surface of the intermediate transfer belt 131 come into contact (or abutment) with each of the photoconductors 112S, 112Y, 112M, 112C, and 112K to form primary transfer nips. Each of the primary transfer rollers 134S, 134Y, 134M, 134C, and 134K is applied with a primary transfer bias by a primary transfer bias power supply. Thus, the primary transfer bias is established between the S, Y, M, C, and K toner images on the respective photoconductors 112S, 112Y, 112M, 112C, and 112K and the respective primary transfer rollers 134S, 134Y, 134M, 134C, and 134K. The color toner images are then sequentially transferred onto the intermediate transfer belt 131.

The S toner image formed on the surface of the photoconductor 112S for special color (S) enters the primary transfer nip for S as the photoconductor 112S rotates. The S toner image is then primarily transferred from the photoconductor 112S onto the intermediate transfer belt 131 due to the action of the transfer bias and the nip pressure. The intermediate transfer belt 131 onto which the S toner image has been primarily transferred then sequentially passes the primary transfer nips for Y, M, C, and K. Next, the Y, M, C, and K toner images on the respective photoconductors 112Y, 112M, 112C, and 112K are sequentially primarily transferred onto the S toner image in an overlapping manner. As a result of the primary transfer in an overlapping manner, a composite toner image is formed on the intermediate transfer belt 131, which includes a color toner image and a special-color toner image having glittering property such as a gold toner image and a silver toner image. In other words, the toner images respectively carried on the surfaces of the color toner image bearer and the special-color toner image bearer are superimposed on and transferred onto the intermediate transfer belt 131.

Each of the primary transfer rollers 134S, 134Y, 134M, 134C, and 134K is an elastic roller comprised of a core metal and a conductive sponge layer fixed on the surface of the core metal. The elastic roller has an outer diameter of 16 mm and the core metal has a diameter of 10 mm. The resistance value R of the sponge layer was calculated from the current I that flows upon application of a voltage of 1,000 V to the core metal of each of the primary transfer rollers 134S, 134Y, 134M, 134C, and 134K with the sponge layer pressed by a grounded metal roller having an outer diameter of 30 mm with a force of 10 N. Specifically, the resistance value R of the sponge layer calculated based on the Ohm's law (R=V/1) from the current I that flows upon application of a voltage of 1,000 V to the core metal is about $3\times10^{7}$Ω. Each of the primary transfer rollers 134S, 134Y, 134M, 134C, and 134K is then applied with a primary transfer bias output from the primary transfer bias power supply under a constant current control. In place of the primary transfer rollers 134S, 134Y, 134M, 134C, and 134K, a transfer charger or a transfer brush may be employed.

The secondary transfer roller 135 sandwiches the intermediate transfer belt 131 and the sheet with the secondary transfer facing roller 136 and is rotationally driven by a driver. The secondary transfer roller 135 is in contact with the front surface of the intermediate transfer belt 131 to form the secondary transfer nip 139 as a transfer nip. The secondary transfer roller 135 also functions as a nip forming member and a transfer member that transfers a toner image from the intermediate transfer belt onto the sheet as a recording medium sandwiched in the secondary transfer nip. The secondary transfer facing roller 136 functions as a nip forming member and a facing member. While the secondary transfer roller 135 is grounded, the secondary transfer facing roller 136 is applied with a secondary transfer bias by a secondary transfer bias power supply 130.

The secondary transfer bias power supply 130 includes both a direct-current power supply and an alternating-current power supply, and is able to output a direct-current voltage superimposed with an alternating-current voltage as the secondary transfer bias. The output terminal of the secondary transfer bias power supply 130 is connected to the core metal of the secondary transfer facing roller 136. The potential of the core metal of the secondary transfer facing roller 136 is substantially the same as the voltage output from the secondary transfer bias power supply 130.

As the secondary transfer bias is applied to the secondary transfer facing roller 136, a secondary transfer bias is formed between the secondary transfer facing roller 136 and the secondary transfer roller 135 that electrostatically moves the toner having the negative polarity from the secondary transfer facing roller 136 side toward the secondary transfer roller 135 side. As a result, the toner having the negative polarity on the intermediate transfer belt 131 can be moved from the secondary transfer facing roller 136 side to the secondary transfer roller 135 side.

The secondary transfer bias power supply 130 uses a direct-current component which has the same negative polarity as the toner and makes the time-averaged potential of the superimposition bias the same negative polarity as the toner. Here, instead of grounding the secondary transfer roller 135 while applying the superimposition bias to the secondary transfer facing roller 136, the core metal of the secondary transfer facing roller 136 may be grounded while applying the superimposition bias to the secondary transfer roller 135. In this case, the polarities of the direct-current voltage and the direct-current component are made different.

In the case of using a sheet having a large surface unevenness such as an embossed sheet, the toner is made to reciprocate by application of the above-described superimposition bias to be relatively moved from the intermediate transfer belt 131 side to the sheet side, thus being transferred onto the sheet. As a result, transferability onto concave portions on the sheet can be improved to improve the transfer rate and to prevent the production of abnormal images such as hollow defects. On the other hand, in the case of using a sheet having a small unevenness such as a normal transfer sheet, since a light and dark pattern that follows the unevenness pattern does not appear, sufficient transferability is achieved only by applying a secondary transfer bias based only on a direct-current component.

The secondary transfer facing roller 136 is comprised of a core metal made of stainless steel, aluminum, or the like and a resistance layer stacked thereon. The secondary transfer facing roller 136 may have an outer diameter of about 24 mm. The diameter of the core metal is about 16 mm. The resistance layer may be comprised of a polycarbonate, fluorine-based rubber, or silicon-based rubber in which conductive particles such as carbon and a metal complex is dispersed, a rubber such as NBR (nitrile rubber) and EPDM (ethylene-propylene-diene monomer), a rubber of NBR/ECO (epichlorohydrin rubber) copolymer, or a semiconducting rubber made of polyurethane. The volume resistance of the resistance layer is from $10^6$ to $10^{12}\Omega$, preferably from $10^7$ to $10^9\Omega$. Either foamed types having a rubber hardness (ASKER-C) of from 20 to 50 degrees or rubber types having a rubber hardness (ASKER-C) of from 30 to 60 degrees may be used. In particular, since the resistance layer contacts the secondary transfer roller 135 via the intermediate transfer belt 131, sponge types that do not produce non-contact portions even with a small contact pressure are preferable.

On the intermediate transfer belt 131 that has passed through the secondary transfer nip after the secondary transfer, residual toner that has not been transferred onto the sheet is remaining. The residual toner is removed from the surface of the intermediate transfer belt 131 by the belt cleaning device 138 provided with a cleaning blade that is in contact with the surface of the intermediate transfer belt 131.

Fixing Device 14

The fixing device 14 employs a belt fixing system and is configured with a pressure roller 142 pressed against a fixing belt 141 that is an endless belt. The fixing belt 141 is wound around a fixing roller 143 and a heating roller 144, and at least one of the rollers is provided with a heat source or heater (e.g., heater, lamp, electromagnetic induction heater). The fixing belt 141 is nipped and pressed between the fixing roller 143 and the pressure roller 142, thus forming a fixing nip between the fixing belt 141 and the pressure roller 142.

The sheet (recording medium) fed into the fixing device 14 is nipped by the fixing nip with the surface bearing an unfixed toner image in close contact with the fixing belt 141. The toner in the toner image is then softened by heat and pressure, thus fixing the toner image. The sheet having the toner image thereon is ejected outside the apparatus. In the case of further forming an image on the opposite side of the sheet to which the toner image has been transferred, the sheet is conveyed and reversed by a sheet reversing mechanism after the toner image has been fixed thereon. Another toner image is then formed on the opposite side of the sheet in the same manner as in the above-described image forming process.

The sheet on which the toner has been fixed by the fixing device 14 is ejected outside the image forming apparatus body 2 via an output roller constituting the sheet ejector 15 and is stored in a sheet storage 151 such as an output tray.

As to the positional relation among the five image forming units 110S, 110Y, 110M, 110C, and 110K, the positions of the image forming units 110S and 110K may be interchanged. With the configuration illustrated in FIG. 1, the special-color toner having glittering property comes to the top position among the five color toners output on the sheet. On the other hand, when the positions of the image forming units 110S and 110K are interchanged, the special-color toner having glittering property comes to the lowest position among the five color toners output on the sheet. By placing another toner on the glittering toner, it is possible to give another color or haze to the glittering color, increasing the number of expressed colors in the image.

As to the positional relation among the image forming units, the positions of the image forming unit 110S, 110Y, 110M, 110C, and 110K may be interchanged with the positions of the image forming units 110Y, 110M, 110C, 110K, and 110S, respectively.

The image forming apparatus illustrated in FIG. 1 including five image forming units may further include another image forming unit containing another special-color toner other than glittering toner, such as clear toner and white toner, to become an image forming apparatus including six or seven image forming units.

In the image forming apparatus illustrated in FIG. 1, an S toner image is formed on the photoconductor 112S in the image forming unit 110S. The S toner on the photoconductor 112S is transferred onto the intermediate transfer belt 131 by the primary transfer roller 134S. The S toner on the intermediate transfer belt 131 advances in the right direction in FIG. 1, comes into contact with the photoconductor 112Y, and is applied with the transfer bias of the primary transfer roller 134Y upon transfer of the Y toner. If the electrical resistance of the S toner is too small as in the case of conventional special-color toners, the S toner will be reversely transferred from the intermediate transfer belt 131 onto the photoconductor 112Y due to charge injection. Reverse transfer of the S toner can be reduced by adjusting the transfer bias. At the same time, however, the transfer rate of the Y toner is reduced, which is undesirable for transferring the Y toner from the photoconductor 112Y onto the intermediate transfer belt 131. According to some embodiments of the present invention, the transfer rate of the Y toner can be increased and the reverse transfer rate of the S toner can be decreased by making the electrical resistances of the S toner and the Y toner close to each other.

Specifically, the absolute difference in volume resistivity between the special-color toner and the colored toner (e.g., Y toner) is made 0.30 log Ω cm or less, more preferably 0.20 log Ωcm or less.

The S toner on the intermediate transfer belt 131 then sequentially comes into contact with the photoconductor 112M, the photoconductor 112C, and the photoconductor 112K and is applied with the transfer bias, and reverse transfer occurs due to charge injection. To increase the transfer rates of M toner, C toner, and K toner and decrease the reverse transfer rate of S toner, similarly, the absolute difference in volume resistivity between the special-color toner and the colored toner (e.g., M toner, C toner, and K toner) is made 0.30 log Ω cm or less, preferably 0.20 log Ωcm or less.

Next, the S toner, the Y toner, the M toner, the C toner, and the K toner on the intermediate transfer belt 131 are transferred onto the sheet at the secondary transfer nip 139. At this time, a part of the toners is not transferred onto the sheet but remains on the intermediate transfer belt due to charge injection. Since the transfer bias is optimized, the closer the electrical resistance of each toner, the better the transfer. The absolute difference in volume resistivity between the special-color toner and the colored toner is 0.30 log Ω cm or less, preferably 0.20 log Ω cm or less. When the absolute difference in volume resistivity is larger than 0.30 log Ωcm and the transfer rate of the special-color toner is optimized, the colored toner remains untransferred in a large amount. By contrast, when the transfer rate of the colored toner is optimized, the special-color toner remains untransferred in a large amount.

Toner Set

The toner set according to an embodiment of the present invention includes a colored toner and a special-color toner. The special-color toner comprises at least one of a plate-like pigment and a film-like pigment. The absolute difference in volume resistivity between the special-color toner and the colored toner is 0.30 log Ω cm or less.

Preferably, the absolute difference in volume resistivity between the special-color toner and the colored toner is 0.20 log Ω cm or less.

Special-Color Toner

The special-color toner contains at least one of a plate-like pigment and a film-like pigment and may optionally contain a wax or crystalline resin capable of being in a needle-like or plate-like state. The special-color toner may further contain other components, as necessary. Hereinafter, the special-color toner may be simply referred to as "toner".

The image forming apparatus or toner set according to some embodiments of the present invention may contain either one type of special-color toner or two or more types of special-color toners.

Circularity of Special-Color Toner

The circularity of the special-color toner is preferably from 0.950 to 0.985.

When the special-color toner has a certain high level of circularity (i.e., the toner has a spherical shape), particles of the plate-like pigment and/or film-like pigment can be distributed within the toner at a certain distance. As a result, the particles of the plate-like pigment and/or film-like pigment are prevented from coming close to each other or coming into contact with each other, thereby preventing deterioration of electrical property and chargeability of the toner. In addition, such a toner having a high circularity is well removable from a photoconductor or transfer belt without damaging it while well maintaining transferability.

When the circularity is 0.950 or more, transferability of the toner is further improved and high-definition images can be reproduced with high quality. Moreover, a photoconductor or transfer belt is hardly damaged when the toner is removed therefrom.

When the circularity is 0.985 or less, the toner is well removable with a blade, and a streaky abnormal image is hardly generated.

Figure 2A:
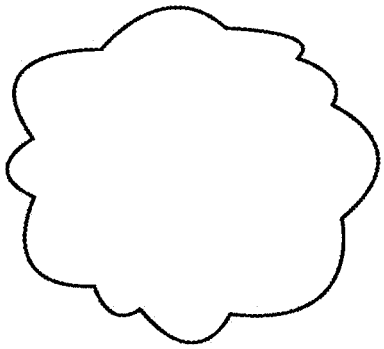
FIG. 2A is an illustration for explaining a procedure for measuring circularity of a toner particle.
Figure 2B:
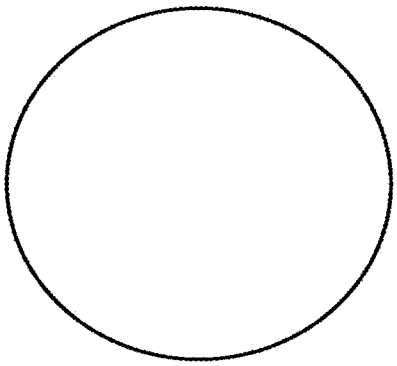
FIG. 2B is an illustration for explaining a procedure for measuring circularity of a toner particle.

Here, the "circularity" refers to an average circularity measured by a flow particle image analyzer FPIA-2000 (available from Sysmex Corporation) in the following manner. First, 0.1 to 0.5 mL of a surfactant, preferably an alkylbenzene sulfonate, serving as a dispersant, is added to 100 to 150 mL of water from which solid impurities have been removed, and further 0.1 to 0.5 g of a sample (toner) is added thereto. The resulting suspension liquid in which the toner is dispersed is subjected to a dispersion treatment by an ultrasonic disperser for about 1 to 3 minutes. The resulting dispersion liquid containing 3,000 to 10,000 toner particles/μL is set to the above-described analyzer and subjected to a measurement of toner shape and distribution. The circularity of a toner particle is determined from a ratio C2/C1, where C1 represents an outer circumferential length of a projected image of the toner particle having a projected area S, as illustrated in FIG. 2A, and C2 represents an outer circumferential length of a true circle having the same area as the projected area S of the toner particle, as illustrated in FIG. 2B. Based on the measurement results, the average of the circularities of the toner particles is determined as the "circularity" of the toner.

Plate-Like Pigment and Film-Like Pigment

The pigment contained in the special-color toner has a plate-like shape or a film-like shape. Preferably, the plate-like pigment or film-like pigment is distributed within the toner so as to have the desired average thickness, maximum length, and maximum width specified in the present disclosure, when observed under the conditions described below.

Preferably, the plate-like pigment or film-like pigment is a metallic pigment that is mainly composed of a metal or coated with a metal. Specific examples of the metallic pigment include, but are not limited to: powders of metals such as aluminum, brass, bronze, nickel, stainless steel, zinc, copper, silver, gold, and platinum; and metal-vapor-deposited flake-like glass powder. The plate-like pigment or film-like pigment mainly composed of a metal refers to a plate-like pigment or film-like pigment in which the proportion of the metal is 50% by mass or more, preferably 70% by mass or more, more preferably 90% by mass or more. Among these, plate-like pigments and film-like pigments mainly composed of aluminum are preferable.

Examples of the plate-like pigments mainly composed of aluminum include, but are not limited to, a small-particle-size aluminum paste pigment (2173YC available from Toyo Aluminium K.K.) and an aluminum pigment powder (1200M available from Toyo Aluminium K.K.).

Examples of the film-like pigments mainly composed of aluminum include, but are not limited to, an aluminum paste pigment (TS-710PM/J available from Toyo Aluminium K.K.).

Preferably, the plate-like pigment or film-like pigment is surface-treated for improving dispersibility and contamination resistance. The plate-like pigment or film-like pigment may be coated with a surface treatment agent, a silane coupling agent, a titanate coupling agent, a fatty acid, a silica particle, an acrylic resin, and/or a polyester resin.

Preferably, the plate-like pigment or film-like pigment is in a scale-like (plate-like) shape, a flat shape, or a thin-film-like shape to provide a light reflection surface. Glittering property is exhibited by such a configuration. Preferably, the plate-like pigment or film-like pigment is in a flake-like shape, so that one particle of the pigment can provide a plane surface having a certain degree of area with a small volume.

One type of plate-like pigment or film-like pigment may be used alone, or two or more types of plate-like pigments or film-like pigments may be used in combination. For adjusting color tone, the plate-like pigment or film-like pigment may be used in combination with other colorants such as dyes and pigments.

Preferably, the proportion of the plate-like pigment in the toner is from 5% to 50% by mass.

Preferably, the proportion of the film-like pigment in the toner is from 0.2% to 10% by mass.

When a cross-section of the toner is observed, preferably, the average thickness D of the plate-like pigment is 1 μm or less and the maximum length L thereof is 5 μm or more. When a fixed image of the toner is observed, preferably, the maximum width W of the plate-like pigment is 3 μm or more.

The toner can secure desired glittering property due to the presence of the plate-like pigment having a certain degree of area.

In the present disclosure, the plate-like pigment refers to a flaky (in other words, scaly, platy, flat, or thin-film-like) pigment having an average thickness D of more than 50 nm, and the film-like pigment refers to a flaky (in other words, scaly, platy, flat, or thin-film-like) pigment having an average thickness D of 50 nm or less.

Average Thickness D

The average thickness D of the plate-like pigment or film-like pigment is determined as follows.

The average thickness D (nm) is determined from the water surface diffusion area WCA ($m^2/g$) per 1 g of the metal component based on the following equation.

$$D\ (\mathrm{nm}) = 400/[WCA\ (\mathrm{m}^2/\mathrm{g})]$$

This method of calculating the average thickness is described in, for example, the publication entitled "Aluminum Paint and Powder, J. D. Edwards, 2nd Edition, Reinhold Publishing Corporation".

The water surface diffusion area is determined in accordance with Japanese Industrial Standards (JIS) K5906-1998 after a pretreatment. The method of measuring the water surface diffusion area described in the JIS K5906-1991 is of a leafing type, while that described in WO99/54074 is of a non-leafing type. Except for pretreating a sample with a 5% by mass stearic acid mineral spirit solution, the operation procedure in the non-leafing type is the same as that in the leafing type.

The pretreatment is described on pages 2 to 16 of the publication entitled "Paint Raw Material Time Report, No. 156, issued by Asahi Kasei Corporation on Sep. 1, 1980".

Preferably, the average thickness D of the plate-like pigment or film-like pigment is 300 nm or less.

When the average thickness D is 300 nm or less, the metal particles are less likely to come into contact with each other, and the electrical resistance value of the toner is less likely to decrease. In addition, the blending ratio of the plate-like pigment or film-like pigment in the toner is low and fixing of the toner is less likely to be inhibited.

The average thickness D is preferably from 15 to 300 nm, more preferably from 20 to 160 nm, and particularly preferably from 25 to 100 nm. When the average thickness D is 15 nm or more, it is unlikely that the toner transmits light to lose glittering property. When the average thickness D is 160 nm or less, glittering property is more excellent.

When the average thickness D of the plate-like pigment or film-like pigment is reduced, the surface area of the pigment is increased, thereby maintaining glittering property even when the blending ratio of the pigment in the toner is reduced. In addition, the electrical resistance of the toner can be increased by reducing the blending ratio and the thickness of the pigment.

Maximum Length L

The maximum length L of the plate-like pigment is determined as follows.

Figure 3A:
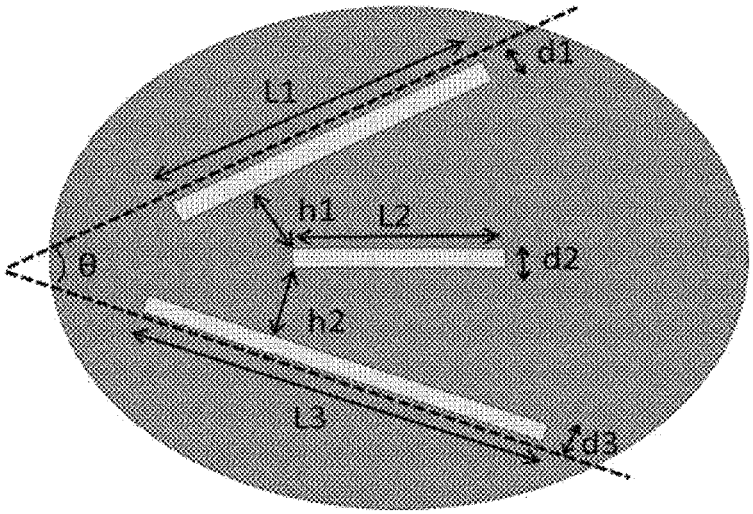
FIG. 3A is an illustration of a cross-sectional image of a toner according to an embodiment of the present invention, observed by a field emission scanning electron microscope (FE-SEM)
Figure 3B:
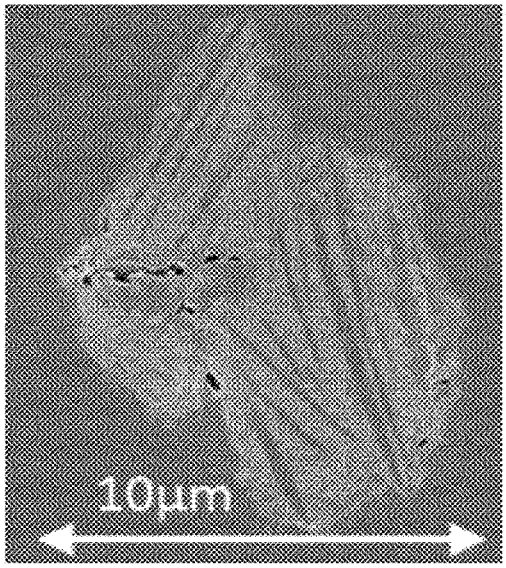
FIG. 3B is a cross-sectional image of a toner according to an embodiment of the present invention, observed by FE-SEM.

In a cross-section of one toner particle containing plate-like pigment particles as illustrated in FIG. 3A, one of the plate-like pigment particles having the longest length l is determined. The longest length l thus determined is represented by L3 in FIG. 3A. The longest length l is determined for other toner particles in the same manner. Specifically, the longest length l is determined for 20 toner particles in total, and the average of the 20 longest lengths l is calculated as the maximum length L.

The maximum length L of the plate-like pigment particles is preferably 5.0 μm or more.

When the maximum length L is 5.0 μm or more, diffuse reflection components are small in quantity and glittering property is hardly lost.

Preferably, the maximum length L is in the range of from 5.0 to 20 μm. When the maximum length L is 20 μm or less, it is easy for the toner particle to incorporate the plate-like pigment particles, and the plate-like pigment particles are unlikely to protrude from the surface of the toner particle, so that the electrical resistance value of the toner is unlikely to decrease. Moreover, the particle diameter of the toner does not become so large that a high-definition image can be easily achieved.

Sample Preparation and FE-SEM Observation Conditions

—Observation Procedure—

1: A sample is dyed in a vaporous atmosphere of a 5% aqueous solution of $RuO_4$.

2: The dyed sample is embedded in a 30-minute-curable epoxy resin and allowed to cure between two TEFLON (registered trademark) plates in parallel.

3: The cured sample in an oval shape is cut with a razor at its central portion.

4: The sample is fixed to an ion milling sample holder with Ag paste so that the cut surface of the sample can be processed.

5: The cut surface is processed by an ion milling device while being cooled at −100 degrees C.

6: The processed cut surface is observed with a cold cathode field emission scanning electron microscope (cold FE-SEM).

Processing conditions and observation conditions are described below.

—Ion Milling Processing Conditions—

ACCELERATION V./3.8 kV (Acceleration voltage setting)

DISCHARGE V./2.0 kV (Discharge voltage setting)

DISCHARGE CURR. Display/386 μA (Discharge current)

ION BEAM CURR. Display/126 μA (Beam current)

Stage Control/C4 Swing Angle±30° Speed/Reciprocating 30 times/min

Ar GAS FLOW/0.08 cm/min

Cooling Temperature/−100 degrees C.

Setting Time/2.5 hours

—SEM Observation Conditions—

Accelerating Voltage: 1.0 kV, WD: 3.8 mm, ×3K, ×3.5K

SEM Image: SE(U), Reflection Electron Image: HA(T)

—Instruments—

Observation: Cold cathode field emission scanning electron microscope (cold FE-SEM) SU8230, product of Hitachi High-Technologies Corporation Processing: Ion milling device IM4000, product of Hitachi High-Technologies Corporation Maximum Width W The maximum width W of the plate-like pigment is determined as follows.

A fixed toner image is formed with the toner while adjusting the toner deposition amount to a low amount of from 0.1 to 0.3 mg/cm$^2$ so that toner particles do not overlap each other as much as possible. In the fixed toner image, the toner particles are melted and only plate-like pigment particles are observable. The fixed toner image is observed with an optical microscope at a magnification of from 200 to 500 times and a reflection image is photographed. Plate-like pigment particles which are independent from each other without being overlapped with another particle are selected from the photograph. (In a case in which small plate-like pigment particles are overlapped above them, the field of view is appropriately adjusted.)

Figure 4:
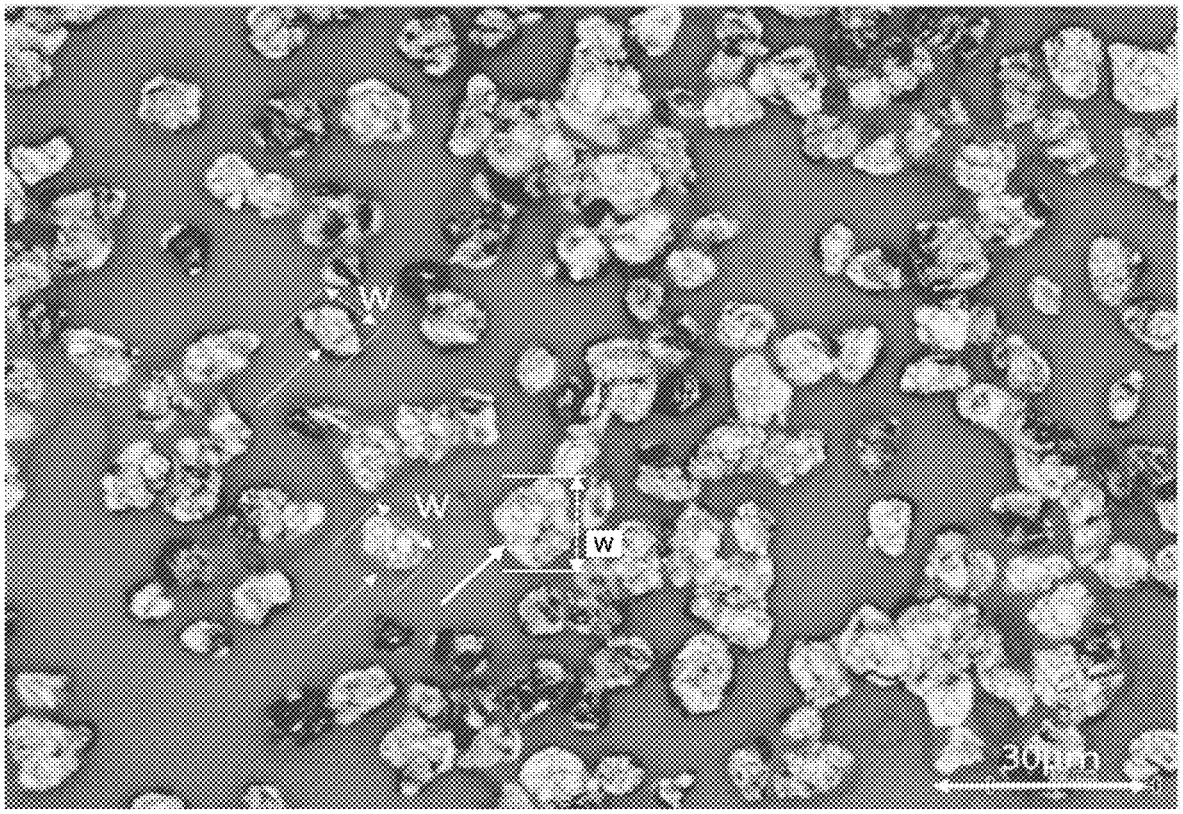
FIG. 4 is an image of a fixed toner image according to an embodiment of the present invention, observed by an optical microscope.

FIG. 4 is an actual microscopic image of the fixed toner image.

In the fixed toner image illustrated in FIG. 4, 20 plate-like pigment particles which are not overlapped with another particle, indicated by arrows, are selected. The largest diameter w is determined for each of the selected plate-like pigment particles. The average of the 20 largest diameters w determined for the 20 selected plate-like pigment particles is calculated as the maximum width W.

The maximum width W is preferably 3.0 μm or more.

When the maximum width W is 3.0 μm or more, the light reflecting area is large, diffuse reflection components is reduced in quantity, and glittering property is hardly lost.

More preferably, the maximum width W is in the range of from 3.0 to 10 μm. When the maximum width W is 10 μm or less, it is easy for the toner particle to incorporate the plate-like pigment particles, and the plate-like pigment particles are unlikely to protrude from the surface of the toner, so that the electrical resistance value of the toner is unlikely to decrease. Moreover, the particle diameter of the toner does not become so large that a high-definition image can be easily reproduced.

Preferably, the plate-like pigment further meets the following requirements.

Average Distance H

In a cross-section of one toner particle containing plate-like pigment particles as illustrated in FIG. 3A, the average value h among the shortest distances h1 and h2 between adjacent plate-like pigment particles is determined. The average value h is determined for other toner particles in the same manner. Specifically, the average value h is determined for toner particles in total, and the average of the 20 average values h is calculated as the average distance H.

Preferably, the average distance H between the plate-like pigment particles is 0.5 μm or more.

In this case, the plate-like pigment particles are distributed in the toner at a certain distance, thereby preventing electrical resistivity decrease or dielectric constant increase of the toner that may be caused by uneven distribution of low-electrical-resistivity substance.

When the average distance H is 0.5 μm or more, the plate-like pigment particles are effectively prevented from coming into contact with each other, thereby preventing decrease of the electrical resistance value of the toner and deterioration of transferability and chargeability of the toner.

More preferably, the average distance H between the plate-like pigment particles is in the range of from 0.5 to 3 μm. When the average distance H is 3 μm or less, a difficulty in reproducing high-definition image due to a large toner particle diameter can be effectively avoided. In addition, a difficulty in exhibiting glittering property due to poor alignment of plate-like pigment particles at the surface of the image at the time when the image is fixed can be effectively avoided.

Deviation Angle θ

In a cross-section of one toner particle containing plate-like pigment particles as illustrated in FIG. 3A, one of the plate-like pigment particles having the longest length is specified. In FIG. 3A, the plate-like pigment particle having a length of L3 is specified. Next, another one of the plate-like pigment particles forming the largest deviation angle with the above-specified plate-like pigment particle having the longest length is specified. A deviation angle θ formed between the above-specified plate-like pigment particle having the longest length and the above-specified plate-like pigment particle forming the largest deviation angle is determined. The deviation angle θ is determined for other toner particles in the same manner. Specifically, the deviation angle θ is determined for 20 toner particles in total.

Preferably, the proportion of toner particles having a deviation angle θ of 20 degrees or more is 30% by number or more based on all the observed toner particles.

At the time when the toner is fixed on a flat surface of paper or film, the toner melts and the plate-like pigment particles tend to align with their surface being parallel. Therefore, the plate-like pigment particles need not necessarily align in the same direction inside the toner particle. The more deviated the orientation of the plate-like pigment particles, the higher the circularity of the toner. In this case, the toner is well removable from a photoconductor or transfer belt without damaging it while well maintaining transferability.

When the proportion of toner particles having a deviation angle θ of 20 degrees or more is 30% by number or more, a decrease of the electrical resistance value of the toner due to excessive alignment of the plate-like pigment particles can be effectively avoided. Glittering property is well exhibited when the pigment particle having the largest particle diameter reflects light to express metallic luster. When toner particles having a deviation angle of 20 degrees or more account for 30% by number of the total toner particles, glittering property is not inhibited because there is no stacked pigment particles close to each other.

To make plate-like pigment particles dispersed with the desired average thickness, maximum length, and maximum width in a nearly-spherical toner having the desired circularity, one of the following procedures (1) to (3) is preferably conducted in the process of producing the toner.

(1) Procedure 1 for Adjusting Circularity of Toner and Distance between Plate-like Pigment Particles One preferred method for producing the toner includes the process of dispersing an organic liquid in an aqueous medium to prepare an oil-in-water emulsion, where the organic liquid contains the plate-like pigment and optionally a substance capable of being in at least one of a needle-like state or a plate-like state. As oil droplets are formed in the aqueous medium, the plate-like pigment particles are allowed to freely move in the oil droplets and prevented from aligned in one direction. The oil droplets thereafter become toner particles in which the plate-like pigment particles and the needle-like or plate-like substance are fixed. Thus, the toner particles are prevented from being in a flat shape. In particular, coexistence of the needle-like or plate-like substance effectively prevents the plate-like pigment particles from being aligned in one direction.

The above method for producing the toner is preferably embodied by a dissolution suspension method which prepares oil droplets by dissolving or dispersing a toner binder resin, a colorant, etc., in an organic solvent, or a suspension polymerization method that uses radical polymerizable monomers.

(2) Procedure 2 for Adjusting Shape of Toner

A flat shape of toner particles may be corrected by reducing the viscosity of the oil droplets in the aqueous medium while applying a shearing force thereto, in the process of producing the toner. In the process of removing the solvent in the dissolution suspension method, or when the polymerization conversion is on the way in the suspension polymerization method, an ellipsoidal shape of toner particles can be corrected into a substantially spherical shape as a shearing force is applied to the dispersion liquid.

(3) Procedure 3 for Adjusting Shape of Toner

In a case in which the plate-like pigment particles are covered with a resin, it is preferable that the surface of the toner has high viscoelasticity.

Specifically, it is preferable that reactive functional groups are preferentially disposed at the surface of the toner to cause a polymeric or cross-linking reaction.

For example, it is possible to use materials capable of reacting at the interface of the oil droplet and the aqueous medium in the process of producing the toner. One of the materials is a reactive prepolymer and contained in the oil droplets. The other is a substance reactive with the prepolymer and contained in the aqueous medium.

It is also effective to dispose solid particles at the surface of the toner so that the surface of the toner maintains high viscoelasticity. For example, it is preferable that organically-modified inorganic particles that are easy to orient at the oil-water interface are contained in the oil droplets. Specific examples of the organically-modified inorganic particles include, but are not limited to, organically-modified bentonite, organically-modified montmorillonite, and organic-solvent-dispersible colloidal silica.

Needle-Like or Plate-Like Substance

It is effective to blend a solid substance in the toner for widening the distance between the planes of the plate-like pigment particles or disposing the plate-like pigment particles inside the toner at a certain distance from the surface of the toner. Preferably, a substance capable of being in a needle-like or plate-like state is blended in the toner for effectively widening the distance between the planes of the plate-like pigment particles. More preferably, the substance is disposed facing a direction different from that of the planes of the plate-like pigment particles.

As described above, the plate-like pigment particles are preferably disposed separated from each other inside the toner.

The substance capable of being in a needle-like or plate-like state can be disposed in the toner facing a direction different from that of the planes of the plate-like pigment particles. As a result, the shape of the toner particle can be changed from a flat shape to a substantially spherical shape. In addition, because the needle-like or plate-like substance is disposed between the plate-like pigment particles while facing a direction different from that of the planes of the plate-like pigment particles, the distance between the planes of the plate-like pigment particles can be widened.

Among toner components, a wax serving as a release agent and a crystalline resin serving as a binder resin that supplements fixability of the toner are easy to be in a needle-like or plate-like state. Therefore, preferably, the toner contains a wax or crystalline resin as the substance capable of being in at least one of a needle-like state or a plate-like state.

Inside the toner, the needle-like or plate-like substance can be disposed in a gap between the plate-like pigment particles, thereby widening the distance between the planes of the plate-like pigment particles. When the needle-like or plate-like substance is a wax or crystalline resin capable of being in a needle-like or plate-like state, releasing property and low-temperature fixability are improved, which is more preferable.

Figure 5:
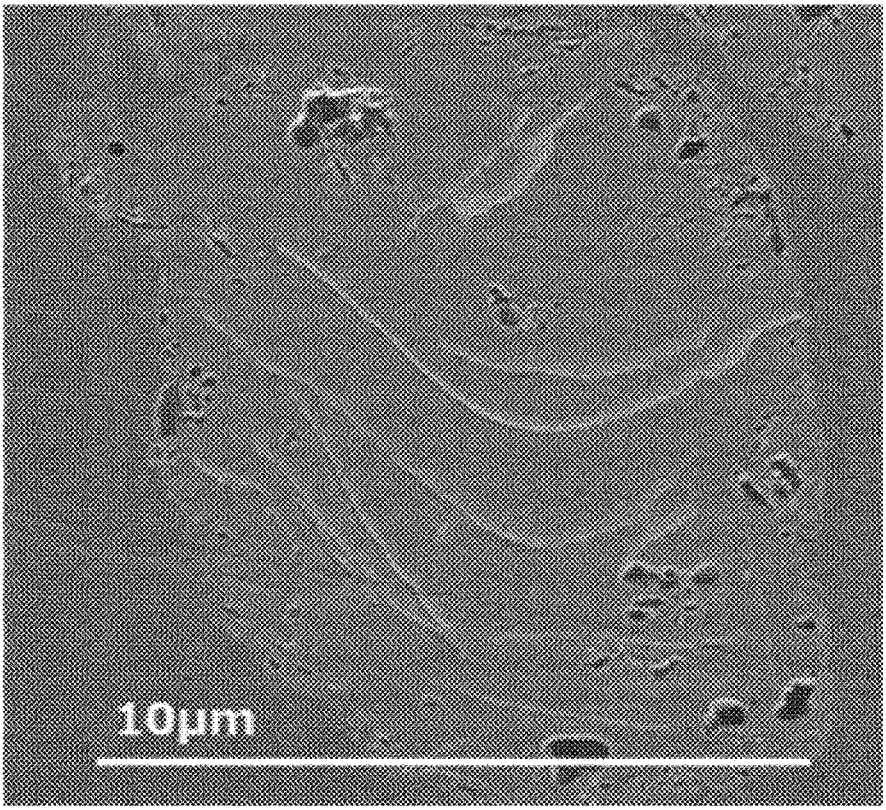
FIG. 5 is a cross-sectional image of a toner according to an embodiment of the present invention containing a film-like pigment, observed by FE-SEM.

FIG. 5 is an actual cross-sectional image of the toner containing the film-like pigment.

The film-like pigment is produced by vapor-depositing a metal on a highly-releasable flat plate and peeling the metal. The average thickness D can be easily controlled by controlling the vapor deposition amount (e.g., vapor deposition time) of the metal. Since the vapor-deposited film is peeled off, the size in the plane direction remains as it is or becomes the size of the split film. In the present disclosure, the toner is produced while splitting the film-like pigment to make the size thereof appropriate.

One preferred method for producing the toner includes the process of dispersing an organic liquid in an aqueous medium to prepare an oil-in-water emulsion, where the organic liquid contains the film-like pigment and other toner materials. By applying a shearing force when oil droplets are formed in the aqueous medium, the film-like pigment is properly split into pieces smaller than the size of toner particles and incorporated into the toner particles. In addition, since the organic liquid has an appropriate viscosity, it is possible to prevent the film-like pigment from curling or folding to collapse when forming the toner particles.

Thus, the average thickness D of the film-like pigment is preferably in the range of from 15 to 50 nm, more preferably from 20 to 40 nm.

When the average thickness D is 50 nm or less, the film-like pigment is likely to split in the process of producing the toner, making it easy to adjust the size of the toner.

When the average thickness D is less than 15 nm, the toner may transmit light and lose glittering property.

When the average thickness D of the film-like pigment is decreased, the surface area of the pigment is increased, thereby maintaining glittering property even when the blending ratio of the pigment in the toner is reduced. In addition, the electrical resistance of the toner can be increased by reducing the blending ratio and the thickness of the pigment.

FIG. 5 is an actual cross-sectional image of the toner containing the film-like pigment.

As can be seen from this actually-observed image, there is a case in which the film-like pigment gets deformed. In this case, it is impossible to determine the deviation angle θ in contrast to the case of the plate-like pigment.

Method for Preparing Needle-Like or Plate-Like Substance

A material to be used as the needle-like or plate-like substance is once dissolved in an organic solvent, cooled, and then precipitated to cause crystal growth and form a needle-like or plate-like morphology. The crystal size can be adjusted by adjusting the material concentration, precipitation speed, stirring condition, and/or cooling speed. Too large a crystal size may be adjusted to an appropriate size by using a homogenizer, high-pressure emulsifier, or bead mill.

As to the appropriate size of the crystal, the average of the long diameters of the needle-like or plate-like substance particles is preferably 10% to 100%, more preferably 20% to 50%, of the average of the long diameters of the plate-like pigment particles. It is preferable that one toner particle contains the needle-like or plate-like substance particles in an amount of 10% to 100% by number of the plate-like pigment particles. In this case, the plate-like pigment particles can be disposed in the toner at a desired distance.

Figure 6:
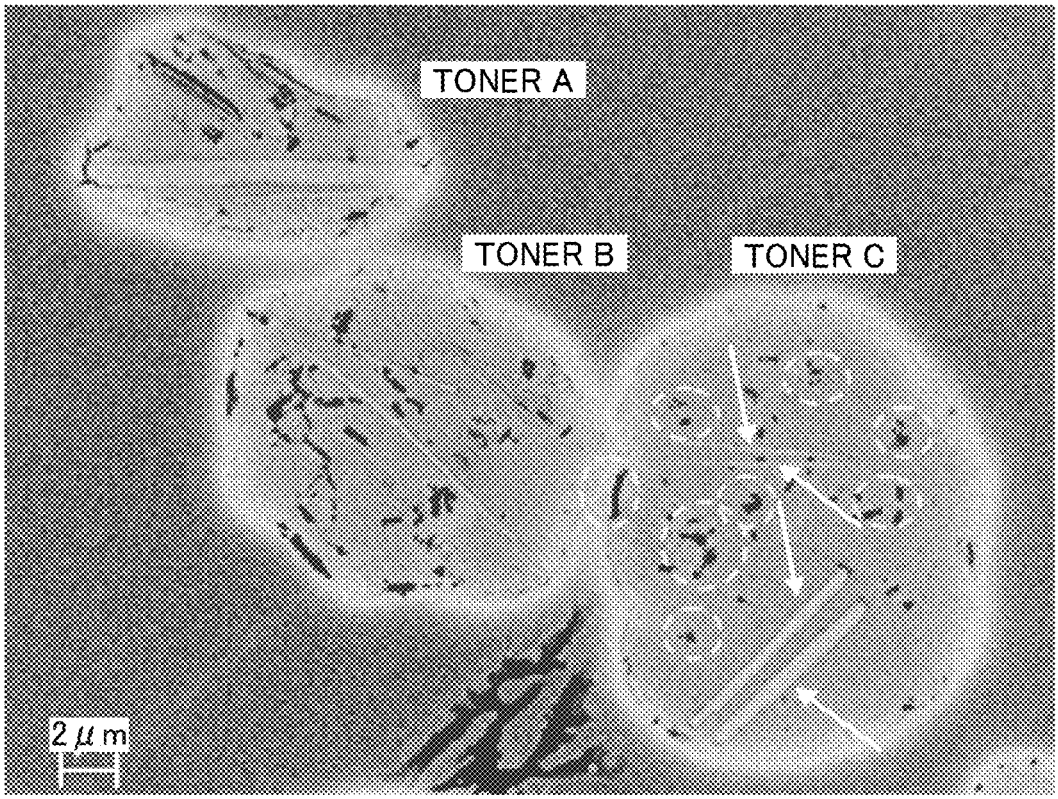
FIG. 6 is a cross-sectional image of a toner according to an embodiment of the present invention, observed by FE-SEM.

FIG. 6 is a cross-sectional image of toner particles in which plate-like pigment particles and needle-like or plate-like wax particles are present together. In FIG. 6, domains indicated by arrows represent plate-like pigment particles and domains encircled by dotted lines represent needle-like or plate-like wax particles.

FIG. 6 is obtained by FE-SEM under the following conditions, and a sample for SEM observation is prepared as follows.

Sample Preparation for FE-SEM Observation

—Observation Procedure—

1: A sample is dyed in a vaporous atmosphere of a 5% aqueous solution of $RuO_4$.

2: The dyed sample is embedded in a 30-minute-curable epoxy resin and allowed to cure between two TEFLON (registered trademark) plates in parallel.

3: The cured sample in an oval shape is cut with a razor at its central portion.

4: The sample is fixed to an ion milling sample holder with Ag paste so that the cut surface of the sample can be processed.

5: The cut surface is processed by an ion milling device while being cooled at −100 degrees C.

6: The sample having the cut surface is dyed again in a vaporous atmosphere of a 5% aqueous solution of $RuO_4$.

7: The processed cut surface is observed with a cold cathode field emission scanning electron microscope (cold FE-SEM).

Other observation conditions are the same as those described in the above "Sample Preparation and FE-SEM Observation Conditions" section.

Wax

Preferably, a wax serving as the needle-like or plate-like substance for preventing stacking of the plate-like pigment particles or widening the distance between the planes of the plate-like pigment particles is provided with a branched structure or a polar group, each of which can be introduced in the process of manufacturing the wax, so that a certain degree of polarity is imparted to the wax. The melting point of the wax may be the same level as the melting temperature of the binder resin of the toner, or may be higher than the melting temperature thereof as long as it is equal to or lower than the temperature of an image being fixed on a paper sheet.

Examples of the needle-like or plate-like substance include modified waxes to which a polar group, such as hydroxyl group, carboxyl group, amide group, and amino group, is introduced. Examples thereof further include oxidization-modified waxes prepared by oxidizing a hydrocarbon by an air oxidization process and metal salts (e.g., potassium salt and sodium salt) thereof; acid-group-containing polymers (e.g., maleic anhydride copolymer and alpha-olefin copolymer) and salts thereof; and alkoxylated products of hydrocarbons modified with imide ester, quaternary amine salt, or hydroxyl group.

Examples of the wax include, but are not limited to, carbonyl-group-containing wax, polyolefin wax, and long-chain hydrocarbon wax.

Specific examples of esterification products of the carbonyl-group-containing wax include, but are not limited to, polyalkanoic acid ester, polyalkanol ester, polyalkanoic acid amide, polyalkyl amide, and dialkyl ketone.

Specific examples of the polyalkanoic acid ester wax include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate.

Specific examples of the polyalkanol ester include, but are not limited to, tristearyl trimellitate and distearyl maleate.

Specific examples of the polyalkanoic acid amide include, but are not limited to, dibehenylamide.

Specific examples of the polyalkyl amide include, but are not limited to, trimellitic acid tristearylamide.

Specific examples of the dialkyl ketone include, but are not limited to, distearyl ketone. Among these carbonyl-group-containing waxes, polyalkanoic acid ester is particularly preferable.

Specific examples of the polyolefin wax include, but are not limited to, polyethylene wax and propylene wax.

Specific examples of the long-chain hydrocarbon wax include, but are not limited to, paraffin wax and SASOL wax.

The melting point of the wax is not particularly limited and can be suitably selected to suit to a particular application, but is preferably from 50 to 100 degrees C., more preferably from 60 to 90 degrees C. When the melting point is 50 degrees C. or higher, heat-resistant storage stability of the toner can be well maintained. When the melting point is 100 degrees C. or lower, cold offset does not occur even when the toner is fixed at a low temperature.

The melting point of the wax can be measured by a differential scanning calorimeter (TA-60WS and DSC-60 available from Shimadzu Corporation) as follows. First, about 5.0 mg of a wax is put in an aluminum sample container. The sample container is put on a holder unit and set in an electric furnace. In nitrogen atmosphere, the sample is heated from 0 degrees C. to 150 degrees C. at a temperature rising rate of 10 degrees C./min, cooled from 150 degrees C. to 0 degrees C. at a temperature falling rate of 10 degrees C./min, and reheated to 150 degrees C. at a temperature rising rate of 10 degrees C./min, thus obtaining a DSC curve. The DSC curve is analyzed with analysis program installed in DSC-60, and the temperature at the largest peak of melting heat in the second heating is determined as the melting point.

Preferably, the melt viscosity of the wax is from 5 to 100 mPa·sec, more preferably from 5 to 50 mPa·sec, and particularly preferably from 5 to 20 mPa·sec, when measured at 100 degrees C. When the melt viscosity is 5 mPa·sec or higher, deterioration of releasability can be prevented. When the melt viscosity is 100 mPa·sec or lower, deterioration of hot offset resistance and low-temperature releasability can be effectively prevented.

The total proportion of the waxes, including the wax serving as the needle-like or plate-like substance and other waxes, in the toner is preferably from 1% to 30% by mass, more preferably from 5% to 10% by mass. When the total proportion is 5% by mass or more, deterioration of hot offset resistance of the toner can be effectively prevented. When the total proportion is 10% by mass or less, deterioration of heat-resistant storage stability, chargeability, transferability, and stress resistance of the toner can be effectively prevented.

The proportion of the wax serving as the needle-like or plate-like substance to the plate-like pigment or film-like pigment is preferably from 1% to 30% by mass, more preferably from 5% to 10% by mass.

Crystalline Resin

Specific preferred examples of the crystalline resin include, but are not limited to, polyester resin prepared from a diol component and a dicarboxylic acid component, ring-opened polymer of lactone, and polymer of polyhydroxycarboxylic acid. Specific preferred examples of the crystalline resin further include urethane-modified polyester resin, urea-modified polyester resin, polyurethane resin, and polyurea resin, each of which having urethane bond and/or urea bond. Among these, urethane-modified polyester resin and urea-modified polyester resin are preferable because they exhibit a high degree of hardness while maintaining crystallinity as the resin.

Urethane-Modified Polyester Resin

The urethane-modified polyester resin may be obtained by a reaction between a polyester resin and an isocyanate component having 2 or more valences, or a reaction between a polyester resin having an isocyanate group on its terminal and a polyol component.

Examples of the polyester resin include polycondensed polyester resin obtained by a polycondensation of a diol component with a dicarboxylic acid component, ring-opened polymer of lactone, and polyhydroxycarboxylic acid. Among these, polycondensed polyester resin obtained by a polycondensation of a diol component with a dicarboxylic acid component is preferable for exhibiting crystallinity.

Diol Component

Preferred examples of the diol component include aliphatic diols, preferably having 2 to 36 carbon atoms in the main chain. Aliphatic diols are of straight-chain type or branched type. In particular, straight-chain aliphatic diols are preferable, and straight-chain aliphatic diols having 4 to 6 carbon atoms are more preferable. The diol component may comprise multiple types of diols. Preferably, the proportion of the straight-chain aliphatic diol in the total diol components is 80% by mol or more, more preferably 90% by mol or more. When the proportion is 80% by mol or more, crystallinity of the resin improves, low-temperature fixability and heat-resistant storage stability go together, and the hardness of the resin improves, which is advantageous.

Specific examples of the straight-chain aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,16-hexadecanediol, 1,17-heptadecanediol, 1,18-octadecanediol, and 1,20-eicosanediol. Among these, ethylene glycol, 1,3-propanediol, 1,4-butanediol, 1,6-hexanediol, 1,9-nonanediol, and 1,10-decanediol are preferable, and 1,4-butanediol and 1,6-hexanediol are more preferable, because they are readily available.

Specific examples of other diols to be used as necessary include, but are not limited to, aliphatic diols having 2 to 36 carbon atoms (e.g., 1,2-propylene glycol, 1,3-butanediol, hexanediol, octanediol, decanediol, dodecanediol, tetradecanediol, neopentyl glycol, and 2,2-diethyl-1,3-propanediol) other than the above-described diols; alkylene ether glycols having 4 to 36 carbon atoms (e.g., diethylene glycol, triethylene glycol, dipropylene glycol, polyethylene glycol, polypropylene glycol, and polytetramethylene ether glycol); alicyclic diols having 4 to 36 carbon atoms (e.g., 1,4-cyclohexanedimethanol and hydrogenated bisphenol A); alkylene oxide ("AO") (e.g., ethylene oxide ("EO"), propylene oxide ("PO"), and butylene oxide ("BO")) adducts (with an adduct molar number of from 1 to 30) of the alicyclic diols; AO (e.g., EO, PO, and BO) adducts (with an adduct molar number of from 2 to 30) of bisphenols (e.g., bisphenol A, bisphenol F, and bisphenol S); polylactone diols (e.g., poly-ε-caprolactone diol); and polybutadiene diols.

Specific examples of alcohols having 3 to 8 or more valences to be used as necessary include, but are not limited to, polyvalent aliphatic alcohols having 3 to 36 carbon atoms and 3 to 8 or more valences (e.g., alkane polyols and intramolecular or intermolecular dehydration product thereof, such as glycerin, trimethylolethane, trimethylolpropane, pentaerythritol, sorbitol, sorbitan, and polyglycerin); sugars and derivatives thereof (e.g., sucrose and methyl glucoside); AO adduct (with an adduct molar number of from 2 to 30) of trisphenols (e.g., trisphenol PA); AO adduct (with an adduct molar number of from 2 to 30) of novolac resins (e.g., phenol novolac and cresol novolac); and acrylic polyols (e.g., copolymer of hydroxyethyl methacrylate or acrylate with other vinyl monomer). Among these, polyvalent aliphatic alcohols having 3 to 8 or more valences and AO adducts of novolac resins are preferable; and AO adducts of novolac resin are more preferable.

Dicarboxylic Acid Component

Preferred examples of the dicarboxylic acid component include aliphatic dicarboxylic acids and aromatic dicarboxylic acids. Aliphatic dicarboxylic acids are of straight-chain type or branched type. In particular, straight-chain dicarboxylic acids are preferable. Among straight-chain dicarboxylic acids, saturated aliphatic dicarboxylic acids having 6 to 12 carbon atoms are particularly preferable.

Specific examples of the dicarboxylic acids include, but are not limited to, alkanedicarboxylic acids having 4 to 36 carbon atoms (e.g., succinic acid, adipic acid, azelaic acid, sebacic acid, dodecanedioic acid, tetradecanedioic acid, hexadecanedioic acid, and octadecanedioic acid); alicyclic dicarboxylic acids having 6 to 40 carbon atoms (e.g., dimmer acids such as dimerized linoleic acid); alkenedicarboxylic acids having 4 to 36 carbon atoms (e.g., alkenyl succinic acids such as dodecenyl succinic acid, pentadecenyl succinic acid, and octadecenyl succinic acid; and maleic acid, fumaric acid, and citraconic acid); and aromatic dicarboxylic acids having 8 to 36 carbon atoms (e.g., phthalic acid, isophthalic acid, terephthalic acid, t-butyl isophthalic acid, 2,6-naphthalenedicarboxylic acid, and 4,4'-biphenyl dicarboxylic acid).

Specific examples of polycarboxylic acids having 3 to 6 or more valences to be used as necessary include, but are not limited to, aromatic polycarboxylic acids having 9 to 20 carbon atoms (e.g., trimellitic acid and pyromellitic acid).

Additionally, acid anhydrides and C1-C4 lower alkyl esters (e.g., methyl ester, ethyl ester, and isopropyl ester) of the above-described dicarboxylic acids and polycarboxylic acids having 3 to 6 or more valences may also be used.

Among the above dicarboxylic acids, it is preferable that one type of the aliphatic dicarboxylic acid (preferably, adipic acid, sebacic acid, or dodecanedioic acid) is used alone or in combination with others. In addition, a copolymer of an aliphatic dicarboxylic acid with an aromatic dicarboxylic acid (preferably, terephthalic acid, isophthalic acid, t-butyl isophthalic acid, or a lower alkyl ester thereof) is also preferable. The proportion of the aromatic dicarboxylic acid in the copolymer is preferably 20% by mol or less.

Ring-Opened Polymer of Lactone

The ring-opened polymer of lactone, serving as the polyester resin, may be obtained by a ring-opening polymerization of lactones (e.g., monolactones (having one ester group in the ring) having 3 to 12 carbon atoms, such as β-propiolactone, γ-butyrolactone, δ-valerolactone, and ε-caprolactone) in the presence of a catalyst (e.g., metal oxide and organic metallic compound.) Among the above lactones, ε-caprolactone is preferable for crystallinity.

The ring-opened polymer of lactone may be obtained by a ring-opening polymerization of the above lactone with the use of a glycol (e.g., ethylene glycol and diethylene glycol) as an initiator, so that hydroxyl group is introduced to a terminal. The terminal hydroxyl group may be further modified into carboxyl group. Additionally, commercially-available products of the ring-opened polymer of lactone may also be used, such as PLACCEL series H1P, H4, H5, and H7 available from DAICEL CORPORATION, which are polycaprolactones with high crystallinity.

Polyhydroxycarboxylic Acid

The polyhydroxycarboxylic acid, serving as the polyester resin, may be directly obtained by a dehydration condensation of a hydroxycarboxylic acid such as glycolic acid and lactic acid (in L-form, D-form, or racemic form). However, the polyhydroxycarboxylic acid is preferably obtained by a ring-opening polymerization of a cyclic ester (having 2 to 3 ester groups in the ring) having 4 to 12 carbon atoms, such as glycolide and lactide (in L-form, D-form, or racemic form), that is a product of an intermolecular dehydration condensation among two or three molecules of a hydroxycarboxylic acid, in the presence of a catalyst (e.g., metal oxide and organic metallic compound), for adjusting molecular weight. Preferred examples of the cyclic ester include L-lactide and D-lactide for crystallinity. The polyhydroxycarboxylic acid may be modified such that hydroxyl group or carboxyl group is introduced to a terminal.

Isocyanate Component Having 2 or More Valences

Examples of the isocyanate component include aromatic isocyanates, aliphatic isocyanates, alicyclic isocyanates, and aromatic aliphatic isocyanates. Preferred examples of the isocyanate component include: aromatic diisocyanates having 6 to 20 carbon atoms, aliphatic diisocyanates having 2 to 18 carbon atoms, alicyclic diisocyanates having 4 to 15 carbon atoms, and aromatic aliphatic diisocyanates having 8 to 15 carbon atoms (here, the number of carbon atoms in NCO groups are excluded); modified products of these diisocyanates (e.g., modified products having urethane group, carbodiimide group, allophanate group, urea group, biuret group, uretdione group, uretonimine group, isocyanurate group, or oxazolidone group); and mixtures of two or more of these compounds. An isocyanate having 3 or more valences may be used in combination, as necessary.

Specific examples of the aromatic isocyanates include, but are not limited to, 1,3-phenylene diisocyanate, 1,4-phenylene diisocyanate, 2,4-tolylene diisocyanate (TDI), 2,6-tolylene diisocyanate (TDI), crude TDI, 2,4'-diphenylmethane diisocyanate (MDI), 4,4'-diphenylmethane diisocyanate (MDI), crude MDI [also known as polyallyl polyisocyanate (PAPI), that is a phosgenation product of crude diaminophenylmethane (that is a condensation product of formaldehyde with an aromatic amine (e.g., aniline) or mixture thereof, where the "an aromatic amine (e.g., aniline) or mixture thereof" includes a mixture of diaminodiphenylmethane with a small amount (e.g., 5 to 20% by mass) of a polyamine having 3 or more functional groups)], 1,5-naphthylene diisocyanate, 4,4',4⁻-triphenylmethane triisocyanate, m-isocyanatophenylsulfonyl isocyanate, and p-isocyanatophenylsulfonyl isocyanate.

Specific examples of the aliphatic isocyanates include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate.

Specific examples of the alicyclic isocyanates include, but are not limited to, isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Specific examples of the aromatic aliphatic isocyanates include, but are not limited to, m-xylylene diisocyanate (XDI), p-xylylene diisocyanate (XDI), and α,α,α',α'-tetramethylxylylene diisocyanate (TMXDI).

The modified products of the diisocyanates include those having urethane group, carbodiimide group, allophanate group, urea group, biuret group, uretdione group, uretonimine group, isocyanurate group, or oxazolidone group. Specifically, examples of the modified products of the diisocyanates include, but are not limited to, modified MDI (e.g., urethane-modified MDI, carbodiimide-modified MDI, and trihydrocarbyl-phosphate-modified MDI), urethane-modified TDI, and mixtures of two or more of these compounds (e.g., a combination of modified MD1 and urethane-modified TDI (i.e., a prepolymer having an isocyanate group)).

Among these compounds, preferred are aromatic diisocyanates having 6 to 15 carbon atoms, aliphatic diisocyanates having 4 to 12 carbon atoms, alicyclic diisocyanates having 4 to 15 carbon atoms (here, the number of carbon atoms in NCO groups are excluded); and more preferred are TDI, MDI, HDI, hydrogenated MDI, and IPDI.

Urea-Modified Polyester Resin

The urea-modified polyester resin may be obtained by a reaction between a polyester resin having an isocyanate group on its terminal and an amine compound.

Amine Component Having 2 or More Valences

Examples of the amine component include aliphatic amines and aromatic amines. Preferred examples of the amine component include aliphatic diamines having 2 to 18 carbon atoms and aromatic diamines having 6 to 20 carbon atoms. An amine having 3 or more valences may be used in combination, as necessary.

Specific examples of the aliphatic diamines having 2 to 18 carbon atoms include, but are not limited to: alkylene diamines having 2 to 6 carbon atoms (e.g., ethylenediamine, propylenediamine, trimethylenediamine, tetramethylenediamine, and hexamethylenediamine); polyalkylene diamines having 4 to 18 carbon atoms (e.g., diethylenetriamine, iminobispropylamine, bis(hexamethylene)triamine, triethylenetetramine, tetraethylenepentamine, and pentaethylenehexamine); C1-C4 alkyl or C2-C4 hydroxyalkyl substitutes of the above compounds (e.g., dialkylaminopropylamine, trimethylhexamethylenediamine, aminoethylethanolamine, 2,5-dimethyl-2,5-hexamethylenediamine, and methyliminobispropylamine); alicyclic or heterocyclic aliphatic diamines (e.g., alicyclic diamines having 4 to 15 carbon atoms, such as 1,3-diaminocyclohexane, isophoronediamine, menthenediamine, and 4,4'-methylenedicyclohexanediamine (hydrogenated methylenedianiline); and heterocyclic diamines having 4 to 15 carbon atoms, such as piperazine, N-aminoethylpiperazine, 1,4-di aminoethylpiperazine, 1,4-bis(2-amino-2-methylpropyl)piperazine, and 3,9-bis(3-aminopropyl)-2,4,8,10-tetraoxaspiro[5,5]undecane); and aromatic aliphatic amines having 8 to 15 carbon atoms (e.g., xylylenediamine and tetrachloro-p-xylylenediamine).

Specific examples of the aromatic diamines having 6 to 20 carbon atoms include, but are not limited to: unsubstituted aromatic diamines (e.g., 1,2-phenylenediamine, 1,3-phenylenediamine, 1,4-phenylenediamine, 2,4'-diphenylmethanediamine, 4,4'-diphenylmethanediamine, crude diphenylmethanediamine (polyphenyl polymethylene polyamine), diaminodiphenyl sulfone, benzidine, thiodianiline, bis(3,4-diaminophenyl) sulfone, 2,6-diaminopyridine, m-aminobenzylamine, triphenylmethane-4,4',4"-triamine, and naphthylenediamine); aromatic diamines having a nuclear-substituted alkyl group having 1 to 4 carbon atoms (e.g., 2,4-tolylenediamine, 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenyl sulfone) and mixtures of isomers thereof at various mixing ratios; aromatic diamines having a nuclear-substituted electron withdrawing group (e.g., halogen group such as C1, Br, I, and F; alkoxy group such as methoxy group and ethoxy group; and nitro group), such as methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromo-diphenylmethane, 3,3'-dichlorobenzidine, 3,3'-dimethoxybenzidine, bis(4-amino-3-chlorophenyl) oxide, bis(4-amino-2-chlorophenyl)propane, bis(4-amino-2-chlorophenyl) sulfone, bis(4-amino-3-methoxyphenyl)decane, bis(4-aminophenyl) sulfide, bis(4-aminophenyl) telluride, bis(4-aminophenyl) selenide, bis(4-amino-3-methoxyphenyl) disulfide, 4,4'-methylenebis(2-iodoaniline), 4,4'-methylenebis(2-bromoaniline), 4,4'-methylenebis(2-fluoroaniline), and 4-aminophenyl-2-chloroaniline); and aromatic diamines having a secondary amino group (i.e., the above unsubstituted aromatic diamines, aromatic diamines having a nuclear-substituted alkyl group having 1 to 4 carbon atoms and mixtures of isomers thereof at various mixing ratios, and aromatic diamines having a nuclear-substituted electron withdrawing group, in which part or all of primary amino groups are substituted with a secondary amino group with a lower alkyl group (e.g., methyl group and ethyl group), such as 4,4'-di(methylamino)diphenylmethane and 1-methyl-2-methylamino-4-aminobenzene).

Specific examples of the amines having 3 or more valences include, but are not limited to, polyamide polyamines (such as low-molecular-weight polyamide polyamine obtainable by a condensation between a dicarboxylic acid (e.g., dimer acid) and an excessive amount (i.e., 2 mol or more per 1 mol of acid) of a polyamine (e.g., alkylenediamine and polyalkylene polyamine)) and polyether polyamines (such as hydrides of cyanoethylation products of polyether polyol (e.g., polyalkylene glycol)).

Polyurethane Resin

Examples of the polyurethane resin include polyurethane resins obtained from a diol component and a diisocyanate component. An alcohol component having 3 or more valences and an isocyanate component may be used in combination, as necessary.

Specific examples of the diol component, diisocyanate component, alcohol component having 3 or more valences, and isocyanate component include the above-described examples therefor.

Polyurea Resin

Examples of the polyurea resin include polyurea resins obtained from a diamine component and a diisocyanate component. An amine component having 3 or more valences and an isocyanate component may be used in combination, as necessary.

Specific examples of the diamine component, diisocyanate component, amine component having 3 or more valences, and isocyanate component include the above-described examples therefor.

Melting Point of Crystalline Resin

The largest peak temperature of melting heat of the crystalline resin is preferably from 45 to 70 degrees C., more preferably from 53 to 65 degrees C., and most preferably from 58 to 62 degrees C., for achieving both low-temperature fixability and heat-resistant storage stability. When the largest peak temperature is 45 degrees C. or higher, low-temperature fixability and heat-resistant storage stability of the toner can be well maintained, and aggregation of toner and carrier caused due to stirring stress in the developing device can be effectively prevented. When the largest peak temperature is 70 degrees C. or lower, low-temperature fixability and heat-resistant storage stability of the toner can be well maintained.

The ratio of the softening temperature to the largest peak temperature of melting heat of the crystalline resin is preferably from 0.80 to 1.55, more preferably from 0.85 to 1.25, much more preferably from 0.90 to 1.20, and particularly preferably from 0.90 to 1.19. The closer to 1.00 the ratio becomes, the more rapidly the resin softens, which is advantageous for achieving both low-temperature fixability and heat-resistant storage stability.

The crystalline resin preferably has a weight average molecular weight (Mw) of from 10,000 to 40,000, more preferably from 15,000 to 35,000, and particularly preferably from 20,000 to 30,000, for achieving both low-temperature fixability and heat-resistant storage stability. When Mw is 10,000 or higher, deterioration of heat-resistant storage stability of the toner is effectively prevented. When Mw is 40,000 or lower, deterioration of low-temperature fixability of the toner is effectively prevented.

The weight average molecular weight (Mw) of resin can be measured by a gel permeation chromatographic ("GPC") instrument (such as HLC-8220 GPC available from Tosoh Corporation). As columns, TSKgel SuperHZM-H 15 cm in 3-tandem (available from Tosoh Corporation) may be used. First, the resin to be measured is dissolved in tetrahydrofuran (THF, containing a stabilizer, available from FUJIFILM Wako Pure Chemical Corporation) to prepare a 0.15% by mass solution thereof. The solution is filtered with a 0.2-μm filter, and the resulting filtrate is used as a sample. Next, 100 μL of the sample (i.e., THF solution of the resin) is injected into the instrument and subjected to a measurement at 40 degrees C. and a flow rate of 0.35 mL/min. The molecular weight of the sample is determined by comparing the molecular weight distribution of the sample with a calibration curve, compiled with several types of monodisperse polystyrene standard samples, that shows the relation between the logarithmic values of molecular weights and the number of counts. The standard polystyrene samples used to create the calibration curve include SHOWDEX STANDARD Std. No. S-7300, S-210, S-390, S-875, S-1980, S-10.9, S-629, S-3.0, and S-0.580 available from Showa Denko K.K. and toluene. As the detector, a refractive index (RI) detector is used.

The crystalline resin may be a block resin having a crystalline unit and a amorphous unit. The crystalline unit may comprise the above-described crystalline resin. The amorphous resin unit may comprise polyester resin, polyurethane resin, and/or polyurea resin, but is not limited thereto. The composition of the amorphous unit may be similar to that of the crystalline unit. Specific examples of monomers for forming the amorphous unit include the above-described diol components, dicarboxylic acid components, diisocyanate components, diamine components, and combinations thereof, but are not limited thereto.

The crystalline resin may be produced by causing a reaction of a crystalline resin precursor having a terminal functional group reactive with an active hydrogen group with a resin or compound (e.g., cross-linking agent and elongating agent) having an active hydrogen group, to thereby increase the molecular weight of the crystalline resin precursor, during the process of producing the toner. The crystalline resin precursor may be obtained by a reaction of a crystalline polyester resin, urethane-modified crystalline polyester resin, urea-modified crystalline polyester resin, crystalline polyurethane resin, or crystalline polyurea resin with a compound having a functional group reactive with an active hydrogen group.

Specific examples of the functional group reactive with an active hydrogen group include, but are not limited to, isocyanate group, epoxy group, carboxylic acid group, and an acid chloride group. Among these, isocyanate group is preferable for reactivity and safety. Specific examples of the compound having an isocyanate group include, but are not limited to, the above-described diisocyanate components.

In a case in which the crystalline resin precursor is obtained by a reaction between a crystalline polyester resin and the diisocyanate component, the crystalline polyester resin preferably has hydroxyl group on its terminal.

The crystalline polyester resin having hydroxyl group may be obtained by a reaction between a diol component and a dicarboxylic acid, where the equivalent ratio [OH]/[COOH] of hydroxyl groups [OH] from the diol component to carboxyl groups [COOH] from the dicarboxylic acid component is preferably from 2/1 to 1/1, more preferably from 1.5/1 to 1/1, and particularly preferably from 1.3/1 to 1.02/1.

With regard to the use amount of the compound having a functional group reactive with an active hydrogen group, in a case in which the crystalline polyester resin precursor is obtained by a reaction between the crystalline polyester resin having hydroxyl group with the diisocyanate component, the equivalent ratio [NCO]/[OH] of isocyanate groups [NCO] from the diisocyanate component to hydroxyl groups [OH] from the crystalline polyester resin having hydroxyl group is preferably from 5/1 to 1/1, more preferably from 4/1 to 1.2/1, and particularly preferably from 2.5/1 to 1.5/1. This ratio is unchanged, although the structural components may be varied, even when the crystalline resin precursor has another type of skeleton or terminal group.

The resin or compound (e.g., cross-linking agent and elongating agent) having an active hydrogen group is not particularly limited and can be suitably selected to suit to a particular application as long as it has an active hydrogen group. In a case in which the functional group reactive with an active hydrogen group is an isocyanate group, resins and compounds having hydroxyl group (e.g., alcoholic hydroxyl group and phenolic hydroxyl group), amino group, carboxyl group, or mercapto group are preferable. In particular, water and amines are preferable in view of reaction speed.

The amines are not particularly limited and can be suitably selected to suit to a particular application. Specific examples thereof include, but are not limited to, phenylenediamine, diethyltoluenediamine, 4,4'-di aminodiphenylmethane, 4,4'-diamino-3,3'-dimethyldicyclohexylmethane, di aminocyclohexane, isophoronediamine, ethylenediamine, tetramethylenediamine, hexamethylenediamine, diethylenetriamine, triethylenetetramine, ethanolamine, hydroxyethylaniline, aminoethyl mercaptan, aminopropyl mercaptan, aminopropionic acid, and aminocaproic acid. In addition, ketimine compounds obtained by blocking amino group in the above-described compounds with ketones (e.g., acetone, methyl ethyl ketone, methyl isobutyl ketone), and oxazoline compounds, may also be used.

Other Components

The special-color toner may further contain a binder resin and a release agent, which are generally used as toner components, in addition to the plate-like pigment or film-like pigment. The binder resin and release agent are not limited to any particular material and can be selected from known materials as long as they meet the requirements in the present disclosure. Other than the above-described crystalline resin and wax capable of being in a needle-like or plate-like state, generally-used release agents and binder resins (e.g., amorphous polyester resins) may be used in the present disclosure.

The special-color toner may further contain other components such as a colorant, a charge control agent, an external additive, a fluidity improving agent, a cleaning improving agent, and a magnetic material.

Colorant

Colorants which can be used in combination with the plate-like pigment or film-like pigment are not particularly limited and can be suitably selected from known colorants to suit to a particular application.

Specific examples of black colorants include, but are not limited to, carbon blacks (C.I. Pigment Black 7) such as furnace black, lamp black, acetylene black, and channel black; metals such as copper, iron (C.I. Pigment Black 11), and titanium oxide; and organic pigments such as aniline black (C.I. Pigment Black 1).

Specific examples of magenta colorants include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, and 269; C.I. Pigment Violet 19; and C.I. Vat Red 1, 2, 10, 13, 15, 23, 29, and 35.

Specific examples of cyan colorants include, but are not limited to, C.I. Pigment Blue 2, 3, 15, 15:1, 15:2, 15:3, 15:4, 15:6, 16, 17, and 60; C.I. Vat Blue 6; and C.I. Acid Blue 45; a copper phthalocyanine pigment having a phthalocyanine skeleton is substituted with 1 to 5 phthalimide methyl groups; and Green 7 and Green 36.

Specific examples of yellow colorants include, but are not limited to, C.I. Pigment Yellow 1, 2, 3, 4, 5, 6, 7, 10, 11, 12, 13, 14, 15, 16, 17, 23, 55, 65, 73, 74, 83, 97, 110, 139, 151, 154, 155, 180, and 185; C.I. Vat Yellow 1, 3, 20; and Orange 36.

The proportion of the colorant in the toner is preferably from 1% to 15% by mass, more preferably from 3% to 10% by mass. When the proportion is 1% by mass or more, deterioration of coloring power of the toner can be prevented. When the proportion is 15% by mass or less, defective dispersion of the colorant in the toner can be prevented, and deterioration of coloring power and electrical property of the toner can be effectively prevented.

The colorant may be combined with a resin to be used as a master batch. Preferably, a toner binder or a resin having a similar structure to the toner binder is used for the mater batch, for improving compatibility with the toner binder, but the resin is not limited thereto.

The master batch may be obtained by mixing and kneading the resin and the coloring pigment while applying a high shearing force thereto. To increase the interaction between the colorant and the resin, an organic solvent may be used. More specifically, the maser batch may be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. The mixing and kneading may be performed by a high shearing dispersing device such as a three roll mill.

Charge Control Agent

The toner may contain a charge control agent for imparting appropriate charging ability to the toner.

Any known charge control agent is usable. Since a colored material may change the color tone of the toner, colorless or whitish materials are preferably used for the charge control agent. Specific examples of such materials include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Each of these materials may be used alone or in combination with others.

The proportion of the charge control agent is determined based on the type of binder resin used and toner manufacturing method (including dispersing method), and is not limited to any particular value. Preferably, the proportion is from 0.01% to 5% by mass, more preferably from 0.02% to 2% by mass, based on the amount of the binder resin. When the proportion is 5% by mass or less, the charge of the toner is not so large that the effect of the charge control agent is exerted and the electrostatic attraction force between the toner and a developing roller is reduced. Thus, lowering of developer fluidity and deterioration of image density can be effectively prevented. When the proportion is 0.01% by mass or more, charge rising property and charge quantity are sufficient.

External Additive

For the purpose of improving fluidity, adjusting charge quantity, and/or adjusting electrical properties, external additives may be added to the toner. The external additive is not particularly limited and can be suitably selected from known materials to suit to a particular application. Specific examples thereof include, but are not limited to, silica particles, hydrophobized silica particles, metal salts of fatty acids (e.g., zinc stearate and aluminum stearate), metal oxides (e.g., titania, alumina, tin oxide, and antimony oxide) and hydrophobized products thereof, and fluoropolymers. Among these, hydrophobized silica particles, titania particles, and hydrophobized titania particles are preferable.

Specific examples of commercially-available hydrophobized silica particles include, but are not limited to, HDK H2000, HDK H2000/4, HDK H2050EP, HVK21, and HDK H1303 (available from Hoechst AG); and R972, R974, RX200, RY200, R202, R805, and R812 (available from Nippon Aerosil Co., Ltd.). Specific examples of commercially-available titania particles include, but are not limited to, P-25 (available from Nippon Aerosil Co., Ltd.); STT-30 and STT-65CS (available from Titan Kogyo, Ltd.); TAF-140 (available from Fuji Titanium Industry Co., Ltd.); and MT-150W, MT-500B, MT-600B, and MT-150A (available from TAYCA Corporation). Specific examples of commercially available hydrophobized titanium oxide particles include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The hydrophobized particles of silica, titania, and alumina can be obtained by treating particles of silica, titania, and alumina, respectively, which are hydrophilic, with a silane coupling agent such as methyltrimethoxysilane, methyltriethoxysilane, and octyltrimethoxysilane. Specific examples of usable hydrophobizing agents include, but are not limited to, silane coupling agents such as dialkyl dihalogenated silane, trialkyl halogenated silane, alkyl trihalogenated silane, and hexaalkyl disilazane; silylation agents; silane coupling agents having a fluorinated alkyl group; organic titanate coupling agents; aluminum coupling agents; silicone oils; and silicone varnishes.

Preferably, primary particles of the external additive have an average particle diameter of from 1 to 100 nm, more preferably from 3 to 70 nm. When the average particle diameter is 1 nm or more, a difficulty in exerting the function due to embodiment of the external additive in the toner can be effectively avoided. When the average particle diameter is 100 nm or less, the surface of a photoconductor is effectively prevented from being non-uniformly damaged. The external additive may comprise a combination of inorganic particles with hydrophobized inorganic particles. More preferably, the external additive comprises at least two types of hydrophobized inorganic particles each having an average primary particle diameter of 20 nm or less and at least one type of hydrophobized inorganic particle having an average primary particle diameter of 30 nm or more. The BET specific surface area of the inorganic particles is preferably from 20 to 500 $m^2/g$.

Preferably, the proportion of the external additive in the toner is from 0.1% to 5% by mass, more preferably from 0.3% to 3% by mass.

Specific examples of the external additive further include resin particles. Specific examples of the resin particles include, but are not limited to, polystyrene particles obtained by soap-free emulsion polymerization, suspension polymerization, or dispersion polymerization; particles of copolymer of methacrylates and/or acrylates; particles of polycondensation polymer such as silicone, benzoguanamine, and nylon; and thermosetting resin particles. By using such resin particles in combination, chargeability of the toner is enhanced, the amount of reversely-charged toner particles is reduced, and the degree of background fouling is reduced.

The proportion of the resin particles in the toner is preferably from 0.01% to 5% by mass, more preferably from 0.1% to 2% by mass.

Electrical Properties of Toner

Preferably, the common logarithm Log R of the volume resistivity R (Ωcm) of the special-color toner is in the range of from 10.5 to 11.5 (Log Ωcm). When the common logarithm Log R is 10.5 Log Ωcm or more, defective charging, background fouling, and toner scattering that may be caused due to an increase of conductivity can be effectively prevented. When the common logarithm Log R is 11.5 Log Ωcm or less, lowering of image density that may be caused due to a high electrical resistance and an increase of charge amount can be effectively prevented.

When the average distance H of the plate-like pigment particles is 0.5 μm or more, the distance between the planes of the plate-like pigment particles is sufficiently secured and thereby the above resistance value comes into the preferable range. In addition, even when the toner is deteriorated by stress, the electrical resistance value of the toner is prevented from decreasing.

Method for Manufacturing Toner

The method for producing the special-color toner and the materials used for the special-color toner can be appropriately selected from known ones as long as they meet the requirements described above. For example, the special-color toner may be produced by a kneading pulverization method or a chemical method that granulates toner particles in an aqueous medium.

In particular, a dissolution suspension method which prepares oil droplets by dissolving or dispersing a toner binder resin, a colorant, etc., in an organic solvent, or a suspension polymerization method that uses radical polymerizable monomers, meets the requirements for the method for producing the special-color toner.

More preferably, the toner is produced by a method including the process of dispersing an organic liquid in an aqueous medium to prepare an oil-in-water emulsion, where the organic liquid contains at least one of the plate-like pigment and the film-like pigment and optionally a substance capable of being in at least one of a needle-like state or a plate-like state. As oil droplets are formed in the aqueous medium, the plate-like or film-like pigment particles and other needle-like or plate-like particles are allowed to freely move in the oil droplets, and the plate-like or film-like pigment particles are prevented from being aligned in one direction. The oil droplets thereafter become toner particles in which the plate-like or film-like pigment particles and the needle-like or plate-like substance are fixed.

Dissolution Suspension Method and Suspension Polymerization Method

The dissolution suspension method may include the processes of dissolving or dispersing toner components including at least a binder resin or resin precursor, a colorant, and a wax in an organic solvent to prepare an oil phase composition, and dispersing or emulsifying the oil phase composition in an aqueous medium, to prepare mother particles of the toner.

Preferably, the organic solvent in which the toner components are dissolved or dispersed is a volatile solvent having a boiling point of less than 100 degrees C., for easy removal of the organic solvent in the succeeding process.

Specific examples of such organic solvents include, but are not limited to, ester-based or ester-ether-based solvents such as ethyl acetate, butyl acetate, methoxybutyl acetate, methyl cellosolve acetate, and ethyl cellosolve acetate; ether-based solvents such as diethyl ether, tetrahydrofuran, dioxane, ethyl cellosolve, butyl cellosolve, and propylene glycol monomethyl ether; ketone-based solvents such as acetone, methyl ethyl ketone, methyl isobutyl ketone, di-n-butyl ketone, and cyclohexanone; alcohol-based solvents such as methanol, ethanol, n-propanol, isopropanol, n-butanol, isobutanol, t-butanol, 2-ethylhexyl alcohol, and benzyl alcohol; and mixtures of two or more of the above solvents.

In the dissolution suspension method, at the time when the oil phase composition is dispersed or emulsified in the aqueous medium, an emulsifier or dispersant may be used, as necessary.

Examples of the emulsifier or dispersant include, but are not limited to, surfactants and water-soluble polymers. Specific examples of the surfactants include, but are not limited to, anionic surfactants (e.g., alkylbenzene sulfonate and phosphate), cationic surfactants (e.g., quaternary ammonium salt type and amine salt type), ampholytic surfactants (e.g., carboxylate type, sulfate salt type, sulfonate type, and phosphate salt type), and nonionic surfactants (e.g., AO-adduct type and polyol type).

Each of these surfactants can be used alone or in combination with others.

Specific examples of the water-soluble polymers include, but are not limited to, cellulose compounds (e.g., methyl cellulose, ethyl cellulose, hydroxyethyl cellulose, ethyl hydroxyethyl cellulose, carboxymethyl cellulose, hydroxypropyl cellulose, and saponification products thereof), gelatin, starch, dextrin, gum arabic, chitin, chitosan, polyvinyl alcohol, polyvinylpyrrolidone, polyethylene glycol, polyethyleneimine, polyacrylamide, acrylic-acid-containing or acrylate-containing polymers (e.g., sodium polyacrylate, potassium polyacrylate, ammonium polyacrylate, sodium hydroxide partial neutralization product of polyacrylic acid, and sodium acrylate-acrylate copolymer), sodium hydroxide (partial) neutralization product of styrene-maleic anhydride copolymer, and water-soluble polyurethanes (e.g. reaction product of polyethylene glycol or polycaprolactone diol with polyisocyanate).

In addition, the above-described organic solvents and plasticizers may be used in combination as an auxiliary agent for emulsification or dispersion.

Preferably, mother particles of the toner are produced by a dissolution suspension method including the process of dispersing or emulsifying an oil phase composition in an aqueous medium containing fine resin particles, where the oil phase composition contains at least a binder resin, a binder resin precursor having a functional group reactive with an active hydrogen group ("prepolymer having a reactive group"), a colorant, and a wax, to allow the prepolymer having a reactive group to react with a compound having an active hydrogen group that is contained in the oil phase composition and/or the aqueous medium.

The fine resin particles may be produced by a known polymerization method, and is preferably obtained in the form of an aqueous dispersion thereof.

An aqueous dispersion of fine resin particles may be prepared by, for example, one of the following methods (a) to (h).

(a) Subjecting a vinyl monomer as a starting material to one of suspension polymerization, emulsion polymerization, seed polymerization, and dispersion polymerization, thereby directly preparing an aqueous dispersion of fine resin particles.

(b) Dispersing a precursor (e.g., monomer and oligomer) of a polyaddition or polycondensation resin (e.g., polyester resin, polyurethane resin, and epoxy resin) or a solvent solution thereof in an aqueous medium in the presence of a dispersant, and allowing the precursor to cure by application of heat or addition of a curing agent, thereby preparing an aqueous dispersion of fine resin particles.

(c) Dissolving an emulsifier in a precursor (e.g., monomer and oligomer) of a polyaddition or polycondensation resin (e.g., polyester resin, polyurethane resin, and epoxy resin) or a solvent solution thereof (preferably in a liquid state, may be liquefied by application of heat), and adding water thereto to cause phase-inversion emulsification, thereby preparing an aqueous dispersion of fine resin particles.

(d) Pulverizing a resin produced by a polymerization reaction (e.g., addition polymerization, ring-opening polymerization, polyaddition, addition condensation, and condensation polymerization) into particles by a mechanical rotary pulverizer or a jet pulverizer, classifying the particles by size to collect desired-size particles, and dispersing the collected particles in water in the presence of a dispersant, thereby preparing an aqueous dispersion of fine resin particles.

(e) Spraying a solvent solution of a resin produced by a polymerization reaction (e.g., addition polymerization, ring-opening polymerization, polyaddition, addition condensation, and condensation polymerization) to form fine resin particles, and dispersing the fine resin particles in water in the presence of a dispersant, thereby preparing an aqueous dispersion of fine resin particles.

(f) Adding a poor solvent to a solvent solution of a resin produced by a polymerization reaction (e.g., addition polymerization, ring-opening polymerization, polyaddition, addition condensation, and condensation polymerization), or cooling the solvent solution of the resin in a case in which the resin is dissolved in the solvent by application of heat, to precipitate fine resin particles, removing the solvent to isolate the fine resin particles, and dispersing the fine resin particles in water in the presence of a dispersant, thereby preparing an aqueous dispersion of fine resin particles.

(g) Dispersing a solvent solution of a resin produced by a polymerization reaction (e.g., addition polymerization, ring-opening polymerization, polyaddition, addition condensation, and condensation polymerization) in an aqueous medium in the presence of a dispersant, and removing the solvent by application of heat or reduction of pressure, thereby preparing an aqueous dispersion of fine resin particles.

(h) Dissolving an emulsifier in a solvent solution of a resin produced by a polymerization reaction (e.g., addition polymerization, ring-opening polymerization, polyaddition, addition condensation, and condensation polymerization), and adding water thereto to cause phase-inversion emulsification, thereby preparing an aqueous dispersion of fine resin particles.

The fine resin particles preferably have a volume average particle diameter of from 10 to 300 nm, more preferably from 30 to 120 nm. When the volume average particle diameter of the fine resin particles is from 10 to 300 nm, deterioration of particle size distribution of the toner can be effectively prevented.

Preferably, the oil phase has a solid content concentration of from 40% to 80%. When the concentration is too high, the oil phase becomes more difficult to emulsify or disperse in an aqueous medium, or to handle, due to high viscosity. When the concentration is too low, toner productivity decreases.

Toner components other than binder resin, such as colorant, wax, and master batch thereof, may be independently dissolved or dispersed in an organic solvent and thereafter mixed in a solution or dispersion of the binder resin.

The aqueous medium may comprise water alone or a combination of water with a water-miscible solvent. Specific examples of the water-miscible solvent include, but are not limited to, alcohols (e.g., methanol, isopropanol, and ethylene glycol), dimethylformamide, tetrahydrofuran, cellosolves (e.g., methyl cellosolve), and lower ketones (e.g., acetone and methyl ethyl ketone).

The method of dispersing or emulsifying the oil phase in the aqueous medium is not particularly limited and known equipment of low-speed shearing type, high-speed shearing type, frictional type, high-pressure jet type, or ultrasonic type may be used. For reducing the particle size of resulting particles, a high-speed shearing type is preferable. When a high-speed shearing disperser is used, the revolution is typically from 1,000 to 30,000 rpm, preferably from 5,000 to 20,000 rpm, but is not limited thereto. The dispersing temperature is typically from 0 to 150 degrees C. (under pressure) and preferably from 20 to 80 degrees C.

The organic solvent may be removed from the resulting emulsion or dispersion by a known method. For example, a method of gradually heating the whole system being stirred under normal or reduced pressure to completely evaporate the organic solvent contained in liquid droplets may be employed.

Mother toner particles dispersed in the aqueous medium are washed and dried by a known method as follows. First, the dispersion is solid-liquid separated by a centrifugal separator or filter press. The resulting toner cake is redispersed in ion-exchange water having a temperature ranging from normal temperature to about 40 degrees C. After optionally adjusting pH by acids and bases, the dispersion is subjected to solid-liquid separation again. These processes are repeated several times to remove impurities and surfactants. The resulting toner cake is then dried by an airflow dryer, a circulation dryer, a decompression dryer, or a vibration fluidizing dryer, thus obtaining toner particles. Undesired ultrafine particles may be removed by a centrifugal separator during the drying process. Alternatively, the particle size distribution may be adjusted by a classifier after the drying process.

The oil phase may also be prepared by replacing the organic solvent with a radical polymerizable monomer and a polymerization initiator. As this oil phase is emulsified and the oil droplets are subjected to a polymerization by application of heat, the toner is prepared by a suspension polymerization method. Specific preferred examples of the radical polymerizable monomer include styrene, acrylate, and methacrylate monomers. The polymerization initiator may be selected from azo initiators or peroxide initiators. The suspension polymerization method needs not include a process for removing organic solvent.

The mother toner particles thus prepared may be mixed with inorganic particles, such as hydrophobic silica powder, for improving fluidity, storage stability, developability, and transferability.

The mixing of such external additive may be performed with a typical powder mixer, preferably equipped with a jacket for inner temperature control. To vary load history given to the external additive, the external additive may be gradually added or added from the middle of the mixing, while optionally varying the rotation number, rolling speed, time, and temperature of the mixer. The load may be initially strong and gradually weaken, or vice versa. Specific examples of usable mixers include, but are not limited to, V-type mixer, ROCKING MIXER, LOEDIGE MIXER, NAUTA MIXER, and HENSCHEL MIXER. The mother toner particles are then allowed to pass a sieve having a mesh size of 250 or more so that coarse particles and aggregated particles are removed, thereby obtaining toner particles.

Colored Toner

The colored toner contains at least a colorant and optionally contains other components, as necessary.

The image forming apparatus or toner set according to some embodiments of the present invention may contain one type of colored toner or two or more types of colored toners, for example, four or more types of colored toners including process colors of yellow (Y), magenta (M), cyan (C), and black (K).

The colorant can be suitably selected from the above-described examples of the colorant for the special-color toner.

The other components can be suitably selected from the above-described examples of the components for the special-color toner.

The colored toner can be manufactured in the same manner as the special-color toner as described above except that the at least one of the plate-like pigment and the film-like pigment having glittering property is not contained.

Developer

The special-color toner and the colored toner may be used as a developer.

The developer contains at least the above-described special-color toner or colored toner and optionally other components such as a carrier.

The developer has excellent transferability and chargeability and is capable of reliably forming high-quality image. The developer may be either a one-component developer or a two-component developer.

The two-component developer may be prepared by mixing the above toner with a carrier. The proportion of the carrier in the two-component developer is not particularly limited and can be suitably selected to suit to a particular application, but is preferably from 90% to 98% by mass, more preferably from 93% to 97% by mass.

Carrier

The carrier is not particularly limited and can be suitably selected to suit to a particular application, but the carrier preferably comprises a core material and a resin layer that covers the core material.

Core Material

The core material is not particularly limited as long as it comprises magnetic particles. Specific preferred examples thereof include ferrite, magnetite, iron, and nickel. In consideration of environmental adaptability that has been remarkably advanced in recent years, manganese ferrite, manganese-magnesium ferrite, manganese-strontium ferrite, manganese-magnesium-strontium ferrite, and lithium ferrite are preferred rather than copper-zinc ferrite that has been conventionally used.

Toner Accommodating Unit

A toner accommodating unit refers to a unit having a function of accommodating toner and accommodating the toner. The toner accommodating unit may be in the form of, for example, a toner container, a developing device, or a process cartridge.

The toner container refers to a container containing the toner.

The developing device refers to a device accommodating the toner and having a developing unit configured to develop an electrostatic latent image into a toner image with the toner.

The process cartridge refers to a combined body of an electrostatic latent image bearer (also referred to as an image bearer) with a developing unit accommodating the toner, detachably mountable on an image forming apparatus. The process cartridge may further include at least one of a charger, an irradiator, and a cleaner.

EXAMPLES

The embodiments of the present invention are further described in detail with reference to the Examples but is not limited to the following Examples. In the following descriptions, "parts" represents parts by mass and "% (percent)" represents percent by mass unless otherwise specified.

Production Example A1

Synthesis of Amorphous Polyester Resin L1

In a reaction vessel equipped with a condenser tube, a stirrer, and a nitrogen introducing tube, 25.3 parts of terephthalic acid, 5.6 parts of adipic acid, 32.2 parts of ethylene oxide 2.2 mol adduct of bisphenol A, 35.7 parts of propylene oxide 2.2 mol adduct of bisphenol A, and 0.2 parts of dibutyltin oxide were put, then allowed to react at 230 degrees C. under normal pressure for 4 hours and subsequently under reduced pressures of from 10 to 15 mmHg for 5 hours. Thus, amorphous polyester resin L1 was prepared.

Production Example A2

Synthesis of Prepolymer 1

In a reaction vessel equipped with a condenser tube, a stirrer, and a nitrogen introducing tube, 682 parts of ethylene oxide 2-mol adduct of bisphenol A, 81 parts of propylene oxide 2-mol adduct of bisphenol A, 283 parts of terephthalic acid, 22 parts of trimellitic anhydride, and 2 parts of dibutyltin oxide were put, then allowed to react at 230 degrees C. under normal pressure for 8 hours and subsequently under reduced pressures of from 10 to 15 mmHg for 5 hours. Thus, an intermediate polyester was prepared. The intermediate polyester had a number average molecular weight (Mn) of 2,100, a weight average molecular weight (Mw) of 9,600, a glass transition temperature (Tg) of 55 degrees C., an acid value of 0.5 mgKOH/g, and a hydroxyl value of 49 mgKOH/g.

In a reaction vessel equipped with a condenser tube, a stirrer, and a nitrogen introducing tube, 411 parts of the intermediate polyester, 89 parts of isophorone diisocyanate, and 500 parts of ethyl acetate were put and allowed to react at 100 degrees C. for 5 hours. Thus, a prepolymer 1 was prepared. The content rate of free isocyanate in the prepolymer 1 was 1.60%. The solid content concentration in the prepolymer 1 was 50% (when measured at 150 degrees C. after leaving the prepolymer to stand for 45 minutes).

Production Example A3

Synthesis of Amorphous Polyester Resin H1

In a reaction vessel equipped with a condenser tube, a stirrer, and a nitrogen introducing tube, 25.3 parts of terephthalic acid, 5.6 parts of adipic acid, 30.9 parts of ethylene oxide 2.2 mol adduct of bisphenol A, 34.3 parts of propylene oxide 2.2 mol adduct of bisphenol A, and 0.2 parts of dibutyltin oxide were put, then allowed to react at 230 degrees C. under normal pressure for 3 hours. Next, 4 parts of trimellitic acid were put in the vessel and allowed to react for 2 hours and subsequently under reduced pressures of from 10 to 15 mmHg for 5 hours. Thus, an amorphous polyester resin H1 was prepared.

Production Example A4

Preparation of Amorphous Polyester Resin Dispersion Liquid P2

First, 80 parts of the amorphous polyester resin L1 and 10 parts of the amorphous polyester resin H1 were dissolved in 90 parts of acetone to obtain an acetone solution. Next, 180 parts of the above-prepared acetone solution and 720 parts of water were mixed using a TK HOMOMIXER (available from PRIMIX Corporation) at 8,000 rpm for 1 minute. The resulting dispersion liquid was then depressurized to volatilize and remove acetone. Thus, an amorphous polyester resin dispersion liquid P2 was prepared.

The particle diameter of the amorphous polyester resin P2 in the above-prepared amorphous polyester resin dispersion liquid P2 was 110 nm when measured by an instrument LA-920 available from HORIBA, Ltd. (i.e., the solid content concentration in the amorphous polyester resin dispersion liquid P2 was 20%).

Production Example A5

Synthesis of Crystalline Polyester Resin C1

In a 5-liter four-neck flask equipped with a nitrogen introducing tube, a dewatering tube, a stirrer, and a thermocouple, 63.1 parts of sebacic acid and 36.9 parts of 1,6-hexanediol were put and allowed to react in the presence of 500 ppm (based on the resin components) of titanium tetraisopropoxide at 180 degrees C. for 10 hours, thereafter at 200 degrees C. for 3 hours, and further under a pressure of 8.3 kPa for 2 hours. Thus, a crystalline polyester resin C1 was prepared.

Production Example A6

Preparation of Crystalline Polyester Resin Dispersion Liquid C1

In a reaction vessel equipped with a stirrer and a thermometer, 25 parts of the crystalline polyester resin C1 and 75 parts of ethyl acetate were put and heated to 80 degrees C. while being stirred, to dissolve the crystalline polyester C1 in ethyl acetate. After being cooled to 30 degrees C., the resulting solution was subjected to a dispersion treatment using a bead mill ULTRAVISCOMILL (available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a crystalline polyester resin dispersion liquid C1 was prepared.

The particle diameter of the crystalline polyester resin C1 in the above-prepared crystalline polyester resin dispersion liquid C1 was 340 nm when measured by an instrument LA-920 available from HORIBA, Ltd. (i.e., the solid content concentration in the crystalline polyester resin dispersion liquid C1 was 25%).

Production Example A7

Preparation of Crystalline Polyester Resin Dispersion Liquid C2

In a vessel, 20 parts of the crystalline polyester resin C1 and 80 parts of water were put and heated to 90 degrees C. to dissolve the crystalline polyester resin C1 in water. The resulting solution was then cooled to 30 degrees C. while being stirred using a TK HOMOMIXER (available from PRIMIX Corporation) at 8,000 rpm. Thus, a crystalline polyester resin dispersion liquid C2 was prepared.

The particle diameter of the crystalline polyester resin C1 in the above-prepared crystalline polyester resin dispersion liquid C2 was 130 nm when measured by an instrument LA-920 available from HORIBA, Ltd. (i.e., the solid content concentration of the crystalline polyester resin C1 was 20%).

Production Example A8

Synthesis of Wax Dispersing Agent 1

In a reaction vessel equipped with a stirrer and a thermometer, 480 parts of xylene and 100 parts of a paraffin wax HNP-9 (available from Nippon Seiro Co., Ltd.) were put and heated until they were dissolved. After the air in the vessel was replaced with nitrogen gas, the temperature was raised to 170 degrees C. Next, a mixture liquid of 740 parts of styrene, 100 parts of acrylonitrile, 60 parts of butyl acrylate, 36 parts of di-t-butyl peroxyhexahydroterephthalate, and 100 parts of xylene was dropped in the vessel over a period of 3 hours, and the temperature was kept at 170 degrees C. for 30 minutes. The solvent was thereafter removed. Thus, a wax dispersing agent 1 was prepared.

Production Example A9

Preparation of Wax Dispersion Liquid W1

In a reaction vessel equipped with a stirrer and a thermometer, 100 parts of an ester wax LW-12 (available from Sanyo Chemical Industries, Ltd.), 40 parts of the wax dispersing agent 1, and 300 parts of ethyl acetate were put and heated to 80 degrees C. while being stirred to dissolve the wax and the wax dispersing agent 1. The resulting solution was then cooled to 30 degrees C. and subjected to a dispersion treatment using a bead mill ULTRAVISCOMILL (available from Aimex Co., Ltd.) filled with 80% by volume of zirconia beads having a diameter of 0.5 mm at a liquid feeding speed of 1 kg/hour and a disc peripheral speed of 6 m/sec. This operation was repeated 3 times (3 passes). Thus, a wax dispersion liquid W1 was prepared.

The particle diameter of particles in the wax dispersion liquid W1 was 350 nm when measured by an instrument LA-920 available from HORIBA, Ltd. (i.e., the solid content concentration of the wax was 20% and the total solid content concentration was 28%.)

Production Example A10

Preparation of Wax Dispersion Liquid W2

In a vessel, 20 parts of an ester wax LW-12 (available from Sanyo Chemical Industries, Ltd.), 1 part of sodium dodecylbenzene sulfonate, and 79 parts of water were put and heated to 90 degrees C. to dissolve the wax in water. The resulting solution was then cooled to 30 degrees C. while being stirred using a TK HOMOMIXER (available from PRIMIX Corporation) at 8,000 rpm. Thus, a wax dispersion liquid W2 was prepared.

The particle diameter of particles in the wax dispersion liquid W2 was 450 nm when measured by an instrument LA-920 available from HORIBA, Ltd. (i.e., the solid content concentration of the wax was 20%.)

Production Example A11

Preparation of Organically-Modified Layered Inorganic Compound Master Batch 1

First, 200 parts of water, 500 parts of an organically-modified layered inorganic compound (CLAYTONE APA available from BYK Japan KK), and 500 parts of the amorphous polyester resin L1 were mixed with a HENSCHEL MIXER (available from NIPPON COKE & ENGINEERING CO., LTD.). The mixture was kneaded with a double roll at 120 degrees C. for 30 minutes, then rolled to cool, and pulverized with a pulverizer. Thus, an organically-modified layered inorganic compound master batch 1 was prepared.

Production Example A12

Preparation of Yellow Pigment Master Batch 1

First, 200 parts of water, 500 parts of C.I. Pigment Yellow 185 (PALIOTOL YELLOW D1155 available from BASF SE), and 500 parts of the amorphous polyester resin L1 were mixed with a HENSCHEL MIXER (available from NIPPON COKE & ENGINEERING CO., LTD.). The mixture was kneaded with a double roll at 120 degrees C. for 30 minutes, then rolled to cool, and pulverized with a pulverizer. Thus, a yellow pigment master batch 1 was prepared.

Production Example A13

Preparation of Magenta Pigment Master Batch 1

First, 200 parts of water, 500 parts of C.I. Pigment Red 269 (RED F-218 available from Dainichiseika Color & Chemicals Mfg. Co., Ltd.), and 500 parts of the amorphous polyester resin L1 were mixed with a HENSCHEL MIXER (available from NIPPON COKE & ENGINEERING CO., LTD.). The mixture was kneaded with a double roll at 120 degrees C. for 30 minutes, then rolled to cool, and pulverized with a pulverizer. Thus, a magenta pigment master batch 1 was prepared.

Production Example A14

Preparation of Cyan Pigment Master Batch 1

First, 200 parts of water, 500 parts of C.I. Pigment Blue 15-3 (CYANINE BLUE 4920 available from Dainichiseika Color & Chemicals Mfg. Co., Ltd.), and 500 parts of the amorphous polyester resin L1 were mixed with a HENSCHEL MIXER (available from NIPPON COKE & ENGINEERING CO., LTD.). The mixture was kneaded with a double roll at 120 degrees C. for 30 minutes, then rolled to cool, and pulverized with a pulverizer. Thus, a cyan pigment master batch 1 was prepared.

Production Example A15

Preparation of Black Pigment Master Batch 1

First, 200 parts of water, 500 parts of a carbon black (NIPEX 60 manufactured by Degussa), and 500 parts of the amorphous polyester resin L1 were mixed with a HENSCHEL MIXER (available from NIPPON COKE & ENGINEERING CO., LTD.). The mixture was kneaded with a double roll at 120 degrees C. for 30 minutes, then rolled to cool, and pulverized with a pulverizer. Thus, a black pigment master batch 1 was prepared.

Production Example A16

Preparation of Aluminum Pigment Dispersion Liquid 1

First, 20 parts of an aluminum pigment powder (1200M available from Toyo Aluminium K.K), 1 part of sodium dodecylbenzene sulfonate, and 79 parts of water were mixed by a TK HOMOMIXER (available from PRIMIX Corporation) at 8,000 rpm for 60 minutes. Thus, an aluminum pigment dispersion liquid 1 was prepared.

Production Example A17

Preparation of Yellow Pigment Dispersion Liquid 1

First, 20 parts of C.I. Pigment Yellow 74 (FAST YELLOW 415 available from Dainichiseika Color & Chemicals Mfg. Co., Ltd.), 1 part of sodium dodecylbenzene sulfonate, and 79 parts of water were mixed by a TK HOMOMIXER (available from PRIMIX Corporation) at 8,000 rpm for 60 minutes. Thus, a yellow pigment dispersion liquid 1 was prepared.

Production Example A18

Preparation of Magenta Pigment Dispersion Liquid 1

First, 20 parts of C.T. Pigment Red 269 (RED F-218 available from Dainichiseika Color & Chemicals Mfg. Co., Ltd.), 1 part of sodium dodecylbenzene sulfonate, and 79 parts of water were mixed by a TK HOMOMIXER (available from PRIMIX Corporation) at 8,000 rpm for 60 minutes. Thus, a magenta pigment dispersion liquid 1 was prepared.

Production Example A19

Preparation of Cyan Pigment Dispersion Liquid 1

First, 20 parts of C.I. Pigment Blue 15-3 (CYANINE BLUE 4920 available from Dainichiseika Color & Chemicals Mfg. Co., Ltd.), 1 part of sodium dodecylbenzene sulfonate, and 79 parts of water were mixed by a TK HOMOMIXER (available from PRIMIX Corporation) at 8,000 rpm for 60 minutes. Thus, a cyan pigment dispersion liquid 1 was prepared.

Production Example A20

Preparation of Black Pigment Dispersion Liquid 1

First, 20 parts of a carbon black (NIPEX 60 available from Degussa), 1 part of sodium dodecylbenzene sulfonate, and 79 parts of water were mixed by a TK HOMOMIXER (available from PRIMIX Corporation) at 8,000 rpm for 60 minutes. Thus, a black pigment dispersion liquid 1 was prepared.

Production Example A21

Synthesis of Fine Organic Particle Emulsion (Fine Particle Dispersion Liquid)

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were put and stirred at a revolution of 400 rpm for 15 minutes. As a result, a white emulsion was obtained. The white emulsion was heated to 75 degrees C. and subjected to a reaction for 5 hours. A 1% aqueous solution of ammonium persulfate in an amount of 30 parts was further added to the emulsion, and the mixture was aged at 75 degrees C. for 5 hours. Thus, a fine particle dispersion liquid was prepared, that was an aqueous dispersion of a vinyl resin (i.e., a copolymer of styrene, methacrylic acid, and a sodium salt of a sulfate of ethylene oxide adduct of methacrylic acid).

The fine particles in the fine particle dispersion liquid had a volume average particle diameter of 0.14 μm when measured by an instrument LA-920 (available from HORIBA, Ltd.).

Production Example A22

Preparation of Aqueous Phase

An aqueous phase was prepared by stir-mixing 2,240 parts of water, 80 parts of the fine particle dispersion liquid, 80 parts of a 48.5% aqueous solution of sodium dodecyl diphenyl ether disulfonate (ELEMINOL MON-7 available from Sanyo Chemical Industries, Ltd.), and 200 parts of ethyl acetate. The aqueous phase was a milky white liquid.

Production Example A23

Preparation of Film-Like Pigment 1

A thin coat of oleic acid was applied to a glass plate. The glass plate coated with oleic acid was placed in a vacuum chamber and aluminum was vapor-deposited on the glass plate. The glass plate was taken out of the vacuum chamber, and the vapor-deposited aluminum was peeled off from the glass plate by air. Thus, a film-like pigment 1 was prepared.

Production Example A24

Preparation of Film-Like Pigment 2

A thin coat of oleic acid was applied to a glass plate. The glass plate coated with oleic acid was placed in a vacuum chamber and aluminum was vapor-deposited on the glass plate. The vapor deposition time was about 80% of that in Production Example A23. The glass plate was taken out of the vacuum chamber, and the vapor-deposited aluminum was peeled off from the glass plate by air. Thus, a film-like pigment 2 was prepared.

Production Example B1

Preparation of Glittering S1 Toner

First, 82 parts of the amorphous polyester resin L1, 20 parts of the crystalline polyester resin dispersion liquid C1, 25 parts of the wax dispersion liquid W1, 2 parts of the organically-modified layered inorganic compound master batch 1, 30 parts of a small-particle-size aluminum paste pigment (2173YC available from Toyo Aluminium K.K., propyl acetate dispersion containing 50% of solid contents), and 63 parts of ethyl acetate were mixed using a TK HOMOMIXER (available from PRIMIX Corporation) at 6,000 rpm for 120 minutes. Thus, an oil phase S1 (containing 50% of solid contents) was prepared.

In a vessel equipped with a stirrer and a thermometer, 174 parts of the aqueous phase was put and kept at 20 degrees C. in water bath. Next, 111 parts of the oil phase S1 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in a shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica FMK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S1 toner was prepared.

Production Example B2

Preparation of Glittering S2 Toner

First, 83 parts of the amorphous polyester resin L1, 20 parts of the crystalline polyester resin dispersion liquid C1, 25 parts of the wax dispersion liquid W1, 30 parts of a small-particle-size aluminum paste pigment (2173YC available from Toyo Aluminium K.K., propyl acetate dispersion containing 50% of solid contents), and 62 parts of ethyl acetate were mixed using a TK HOMOMIXER (available from PRIMIX Corporation) at 6,000 rpm for 120 minutes. Thus, an oil phase S2 (containing 50% of solid contents) was prepared.

In a vessel equipped with a stirrer and a thermometer, 172.5 parts of the aqueous phase was put and kept at 20 degrees C. in water bath. Next, 110 parts of the oil phase S2 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in an elliptical shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica FMK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S2 toner was prepared.

Production Example B3

Preparation of Glittering S3 Toner

First, 78 parts of the amorphous polyester resin L1, 20 parts of the crystalline polyester resin dispersion liquid C1, 10 parts of the amorphous polyester resin H1, 25 parts of the wax dispersion liquid W1, 30 parts of a small-particle-size aluminum paste pigment (2173YC available from Toyo Aluminium K.K., propyl acetate dispersion containing 50% of solid contents), and 67 parts of ethyl acetate were mixed using a TK HOMOMIXER (available from PRIMIX Corporation) at 6,000 rpm for 120 minutes. Thus, an oil phase S3 (containing 50% of solid contents) was prepared.

In a vessel equipped with a stirrer and a thermometer, 172.5 parts of the aqueous phase was put and kept at 20 degrees C. in water bath. Next, 110 parts of the oil phase S3 maintained at 20 degrees C. was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a flat shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in an elliptical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-1501IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S3 toner was prepared.

Production Example B4

Preparation of Glittering S4 Toner

First, 70 parts of the amorphous polyester resin dispersion liquid P2, 5 parts of the crystalline polyester resin dispersion liquid C2, 5 parts of the wax dispersion liquid W2, and 15 parts of the aluminum pigment dispersion liquid 1 were mixed using a TK HOMOMIXER (available from PRIMIX Corporation) at 6,000 rpm for 120 minutes. Thus, an aqueous solution S4 (containing 20% of solid contents) dispersing fine particles was prepared.

The aqueous solution S4 was stirred by a THREE-ONE MOTOR equipped with a paddle stirring blade at a revolution or 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, 20 parts of the amorphous polyester resin dispersion liquid P2 were further added to form shell layers around the aggregated particles. The inner temperature was raised to 65 degrees C. and maintained for 1 hour for sintering particles. The resulting aggregated particles were in a flat shape.

After the series of filtration, re-slurry, and water washing was repeated for 5 times and when the conductivity of the slurry became 50 μS/cm, the filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S4 toner was prepared.

Production Example B5

Preparation of Y1 Toner

First, 76 parts of the amorphous polyester resin L1, 20 parts of the crystalline polyester resin dispersion liquid C1, 25 parts of the wax dispersion liquid W1, 2 parts of the organically-modified layered inorganic compound master batch 1, 12 parts of the yellow pigment master batch 1, and 69 parts of ethyl acetate were mixed using a TK HOMOMIXER (available from PRIMIX Corporation) at 6,000 rpm for 120 minutes. Thus, an oil phase Y1 (containing 50% of solid contents) was prepared.

In a vessel equipped with a stirrer and a thermometer, 160.5 parts of the aqueous phase was put and kept at 20 degrees C. in water bath. Next, 102 parts of the oil phase Y1 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. The solvent was removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-1501IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a Y1 toner was prepared.

Production Example B6

Preparation of M1 Toner

First, 76 parts of the amorphous polyester resin L1, 20 parts of the crystalline polyester resin dispersion liquid C1, 25 parts of the wax dispersion liquid W1, 2 parts of the organically-modified layered inorganic compound master batch 1, 12 parts of the magenta pigment master batch 1, and 69 parts of ethyl acetate were mixed using a TK HOMOMIXER (available from PRIMIX Corporation) at 6,000 rpm for 120 minutes. Thus, an oil phase M1 (containing 50% of solid contents) was prepared.

In a vessel equipped with a stirrer and a thermometer, 160.5 parts of the aqueous phase was put and kept at 20 degrees C. in water bath. Next, 102 parts of the oil phase M1 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. The solvent was removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, an M1 toner was prepared.

Production Example B7

Preparation of C1 Toner

First, 77 parts of the amorphous polyester resin L1, 20 parts of the crystalline polyester resin dispersion liquid C1, 25 parts of the wax dispersion liquid W1, 2 parts of the organically-modified layered inorganic compound master batch 1, 10 parts of the cyan pigment master batch 1, and 68 parts of ethyl acetate were mixed using a TK HOMOMIXER (available from PRIMIX Corporation) at 6,000 rpm for 120 minutes. Thus, an oil phase C1 (containing 50% of solid contents) was prepared.

In a vessel equipped with a stirrer and a thermometer, 159 parts of the aqueous phase was put and kept at 20 degrees C. in water bath. Next, 101 parts of the oil phase C1 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. The solvent was removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a C1 toner was prepared.

Production Example B8

Preparation of K1 Toner

First, 77 parts of the amorphous polyester resin L1, 20 parts of the crystalline polyester resin dispersion liquid C1, 25 parts of the wax dispersion liquid W1, 2 parts of the organically-modified layered inorganic compound master batch 1, 10 parts of the black pigment master batch 1, and 69 parts of ethyl acetate were mixed using a TK HOMOMIXER (available from PRIMIX Corporation) at 6,000 rpm for 120 minutes. Thus, an oil phase C1 (containing 50% of solid contents) was prepared.

In a vessel equipped with a stirrer and a thermometer, 159 parts of the aqueous phase was put and kept at 20 degrees C. in water bath. Next, 102 parts of the oil phase K1 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. The solvent was removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a K1 toner was prepared.

Production Example B9

Preparation of Y2 Toner

First, 70 parts of the amorphous polyester resin dispersion liquid P2, 5 parts of the crystalline polyester resin dispersion liquid C2, 5 parts of the wax dispersion liquid W2, and 6 parts of the yellow pigment dispersion liquid 1 were mixed using a TK HOMOMIXER (available from PRIMIX Corporation) at 6,000 rpm for 120 minutes. Thus, an aqueous solution Y2 (containing 20% of solid contents) dispersing fine particles was prepared.

The aqueous solution Y2 was stirred by a THREE-ONE MOTOR equipped with a paddle stirring blade at 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, 20 parts of the amorphous polyester resin dispersion liquid P2 were further added to form shell layers around the aggregated particles. The inner temperature was raised to 65 degrees C. and maintained for 1 hour for sintering particles.

After the series of filtration, re-slurry, and water washing was repeated for 5 times and when the conductivity of the slurry became 50 μS/cm, the filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a Y2 toner was prepared.

Production Example B10

Preparation of M2 Toner

First, 70 parts of the amorphous polyester resin dispersion liquid P2, 5 parts of the crystalline polyester resin dispersion liquid C2, 5 parts of the wax dispersion liquid W2, and 6 parts of the magenta pigment dispersion liquid 1 were mixed using a TK HOMOMIXER (available from PRIMIX Corporation) at 6,000 rpm for 120 minutes. Thus, an aqueous solution M2 (containing 20% of solid contents) dispersing fine particles was prepared.

The aqueous solution M2 was stirred by a THREE-ONE MOTOR equipped with a paddle stirring blade at 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, 20 parts of the amorphous polyester resin dispersion liquid P2 were further added to form shell layers around the aggregated particles. The inner temperature was raised to 65 degrees C. and maintained for 1 hour for sintering particles.

After the series of filtration, re-slurry, and water washing was repeated for 5 times and when the conductivity of the slurry became 50 μS/cm, the filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, an M2 toner was prepared.

Production Example B11

Preparation of C2 Toner

First, 70 parts of the amorphous polyester resin dispersion liquid P2, 5 parts of the crystalline polyester resin dispersion liquid C2, 5 parts of the wax dispersion liquid W2, and 5 parts of the cyan pigment dispersion liquid 1 were mixed using a TK HOMOMIXER (available from PRIMIX Corporation) at 6,000 rpm for 120 minutes. Thus, an aqueous solution C2 (containing 20% of solid contents) dispersing fine particles was prepared.

The aqueous solution C2 was stirred by a THREE-ONE MOTOR equipped with a paddle stirring blade at 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, 20 parts of the amorphous polyester resin dispersion liquid P2 were further added to form shell layers around the aggregated particles. The inner temperature was raised to 65 degrees C. and maintained for 1 hour for sintering particles.

After the series of filtration, re-slurry, and water washing was repeated for 5 times and when the conductivity of the slurry became 50 μS/cm, the filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a C2 toner was prepared.

Production Example B12

Preparation of K2 Toner

First, 70 parts of the amorphous polyester resin dispersion liquid P2, 5 parts of the crystalline polyester resin dispersion liquid C2, 5 parts of the wax dispersion liquid W2, and 5 parts of the black pigment dispersion liquid 1 were mixed using a TK HOMOMIXER (available from PRIMIX Corporation) at 6,000 rpm for 120 minutes. Thus, an aqueous solution K2 (containing 20% of solid contents) dispersing fine particles was prepared.

The aqueous solution K2 was stirred by a THREE-ONE MOTOR equipped with a paddle stirring blade at 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, 20 parts of the amorphous polyester resin dispersion liquid P2 were further added to form shell layers around the aggregated particles. The inner temperature was raised to 65 degrees C. and maintained for 1 hour for sintering particles.

After the series of filtration, re-slurry, and water washing was repeated for 5 times and when the conductivity of the slurry became 50 μS/cm, the filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a K2 toner was prepared.

Production Example B13

Preparation of Glittering S5 Toner

First, 82 parts of the amorphous polyester resin L1, 20 parts of the crystalline polyester resin dispersion liquid C1, 25 parts of the wax dispersion liquid W1, 2 parts of the organically-modified layered inorganic compound master batch 1, 30 parts of a small-particle-size aluminum paste pigment (O670TS available from Toyo Aluminium K.K., propyl acetate dispersion containing 50% of solid contents), and 63 parts of ethyl acetate were mixed using a TK HOMOMIXER (available from PRIMIX Corporation) at 6,000 rpm for 120 minutes. Thus, an oil phase S5 (containing 50% of solid contents) was prepared.

In a vessel equipped with a stirrer and a thermometer, 174 parts of the aqueous phase was put and kept at 20 degrees C. in water bath. Next, 111 parts of the oil phase S5 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in a shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S5 toner was prepared.

Production Example B14

Preparation of Glittering S6 Toner

First, 82 parts of the amorphous polyester resin L1, 20 parts of the crystalline polyester resin dispersion liquid C1, 25 parts of the wax dispersion liquid W1, 2 parts of the organically-modified layered inorganic compound master batch 1, 20 parts of a small-particle-size aluminum paste pigment (O670TS available from Toyo Aluminium K.K., propyl acetate dispersion containing 50% of solid contents), and 63 parts of ethyl acetate were mixed using a TK HOMOMIXER (available from PRIMIX Corporation) at 6,000 rpm for 120 minutes. Thus, an oil phase S6 (containing 50% of solid contents) was prepared.

In a vessel equipped with a stirrer and a thermometer, 174 parts of the aqueous phase was put and kept at 20 degrees C. in water bath. Next, 111 parts of the oil phase S6 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in a shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S6 toner was prepared.

Production Example B15

Preparation of Glittering S7 Toner

First, 82 parts of the amorphous polyester resin L1, 20 parts of the crystalline polyester resin dispersion liquid C1, 25 parts of the wax dispersion liquid W1, 2 parts of the organically-modified layered inorganic compound master batch 1, 5 parts of the film-like pigment 1, and 68 parts of ethyl acetate were mixed using a TK HOMOMIXER (available from PRIMIX Corporation) at 6,000 rpm for 120 minutes. Thus, an oil phase S7 (containing 50% of solid contents) was prepared.

In a vessel equipped with a stirrer and a thermometer, 174 parts of the aqueous phase was put and kept at 20 degrees C. in water bath. Next, 111 parts of the oil phase S7 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in a shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica FMK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S7 toner was prepared.

Production Example B16

Preparation of Glittering S8 Toner

First, 82 parts of the amorphous polyester resin L1, 20 parts of the crystalline polyester resin dispersion liquid C1, 25 parts of the wax dispersion liquid W1, 2 parts of the organically-modified layered inorganic compound master batch 1, 2 parts of the film-like pigment 1, and 65 parts of ethyl acetate were mixed using a TK HOMOMIXER (available from PRIMIX Corporation) at 6,000 rpm for 120 minutes. Thus, an oil phase S8 (containing 50% of solid contents) was prepared.

In a vessel equipped with a stirrer and a thermometer, 174 parts of the aqueous phase was put and kept at 20 degrees C. in water bath. Next, 111 parts of the oil phase S8 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in a shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S8 toner was prepared.

Production Example B17

Preparation of Glittering S9 Toner

First, 82 parts of the amorphous polyester resin L1, 20 parts of the crystalline polyester resin dispersion liquid C1, 25 parts of the wax dispersion liquid W1, 2 parts of the organically-modified layered inorganic compound master batch 1, 2 parts of the film-like pigment 2, and 65 parts of ethyl acetate were mixed using a TK HOMOMIXER (available from PRIMIX Corporation) at 6,000 rpm for 120 minutes. Thus, an oil phase S9 (containing 50% of solid contents) was prepared.

In a vessel equipped with a stirrer and a thermometer, 174 parts of the aqueous phase was put and kept at 20 degrees C. in water bath. Next, 111 parts of the oil phase S9 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in a shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S9 toner was prepared.

Production Example B18

Preparation of Glittering S10 Toner

First, 82 parts of the amorphous polyester resin L1, 20 parts of the crystalline polyester resin dispersion liquid C1, 25 parts of the wax dispersion liquid W1, 2 parts of the organically-modified layered inorganic compound master batch 1, 60 parts of a small-particle-size aluminum paste pigment (TCR3130 available from Toyo Aluminium K.K., propyl acetate dispersion containing 50% of solid contents), and 63 parts of ethyl acetate were mixed using a TK HOMOMIXER (available from PRIMIX Corporation) at 6,000 rpm for 120 minutes. Thus, an oil phase S10 (containing 50% of solid contents) was prepared.

In a vessel equipped with a stirrer and a thermometer, 174 parts of the aqueous phase was put and kept at 20 degrees C. in water bath. Next, 111 parts of the oil phase S10 to which 5 parts of the prepolymer 1 had been added, maintained at 20 degrees C., was put into the aqueous phase and mixed by a TK HOMOMIXER (available from PRIMIX Corporation) at 8,000 rpm for 2 minutes while keeping the temperature at 20 degrees C. Thus, an emulsion slurry was prepared. As a result of observation with an optical microscope, the resulting oil droplets were in a slightly elliptical shape. The emulsion slurry was put in a vessel equipped with a stirrer and a thermometer, and the solvent was removed therefrom at 40 degrees C. under reduced pressures, thus obtaining a slurry containing 80% of oil droplets on solid basis.

The slurry was mixed by a TK HOMOMIXER (available from PRIMIX Corporation) at 8,000 rpm for 5 minutes while keeping the temperature at 40 degrees C., thus applying a shearing stress to the slurry. As a result of observation with an optical microscope, the resulting oil droplets were in a shape close to a spherical shape. The solvent was further removed from the slurry at 40 degrees C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45 degrees C. for 48 hours and sieved with a mesh having an opening of 75 μm. Thus, mother toner particles were prepared.

Next, 100 parts of the mother toner particles, 1 part of a hydrophobized silica HDK-2000 (available from Wacker Chemie AG), and 1 part of a surface-treated titanium oxide JMT-150IB (available from Tayca Corporation) were mixed by a HENSCHEL MIXER (available from NIPPON COKE & ENGINEERING CO., LTD.) at a peripheral speed of 30 m/s for 30 seconds, followed by a pause for 1 minute. This operation was repeated 5 times. The mixture was sieved with a mesh having an opening of 35 μm. Thus, a glittering S10 toner was prepared.

The formulations of the mother toners prepared in the Production Examples, from which the solvent and moisture have been removed, are described in Tables 1-1 and 1-2. The unit for the numerals is "part by mass".

TABLE 1-1

| | Amorphous Polyester Resin L1 | Prepolymer 1 | Amorphous Polyester Resin H1 | Crystalline Polyester Resin C1 | Ester Wax | Wax Dispersing Agent 1 | APA |
|---|---|---|---|---|---|---|---|
| S1 Toner | 83 | 5 | — | 5 | 5 | 2 | 1 |
| S2 Toner | 83 | 5 | — | 5 | 5 | 2 | — |
| S3 Toner | 78 | — | 10 | 5 | 5 | 2 | — |
| S4 Toner | 80 | — | 10 | 5 | 5 | — | — |
| Y1 Toner | 83 | 5 | — | 5 | 5 | 2 | 1 |
| M1 Toner | 83 | 5 | — | 5 | 5 | 2 | 1 |
| C1 toner | 83 | 5 | — | 5 | 5 | 2 | 1 |
| K1 toner | 83 | 5 | — | 5 | 5 | 2 | 1 |
| Y2 Toner | 80 | — | 10 | 5 | 5 | — | — |
| M2 Toner | 80 | — | 10 | 5 | 5 | — | — |
| C2 toner | 80 | — | 10 | 5 | 5 | — | — |
| K2 toner | 80 | — | 10 | 5 | 5 | — | — |
| S5 Toner | 83 | 5 | — | 5 | 5 | 2 | 1 |
| S6 Toner | 83 | 5 | — | 5 | 5 | 2 | 1 |
| S7 Toner | 83 | 5 | — | 5 | 5 | 2 | 1 |
| S8 Toner | 83 | 5 | — | 5 | 5 | 2 | 1 |
| S9 Toner | 83 | 5 | — | 5 | 5 | 2 | 1 |
| S10 Toner | 83 | 5 | — | 5 | 5 | 2 | 1 |

TABLE 1-2

| | Pigment | | | | | | | | | | | |
|---|---|---|---|---|---|---|---|---|---|---|---|---|
| | Highly Glittering Pigment (Aluminum) | | | | | | | | | | | |
| | 2173 YC | 1200 M | 0670 TS | Film-like Pigment 1 | Film-like Pigment 2 | TCR 3130 | Yellow 185 | Yellow 74 | Red 269 | Blue 15-3 | Carbon Black | Manufacturing Method |
| S1 | 15 | | | | | | | | | | | Dissolution |
| Toner | | | | | | | | | | | | Suspension |
| S2 | 15 | | | | | | | | | | | Dissolution |
| Toner | | | | | | | | | | | | Suspension |
| S3 | 15 | | | | | | | | | | | Dissolution |
| Toner | | | | | | | | | | | | Suspension |
| S4 | | 15 | | | | | | | | | | Emulsion |
| Toner | | | | | | | | | | | | Aggregation |
| Y1 | | | | | | | 6 | | | | | Dissolution |
| Toner | | | | | | | | | | | | Suspension |
| M1 | | | | | | | | | 6 | | | Dissolution |
| Toner | | | | | | | | | | | | Suspension |
| C1 | | | | | | | | | | 5 | | Dissolution |
| toner | | | | | | | | | | | | Suspension |
| K1 | | | | | | | | | | | 5 | Dissolution |
| toner | | | | | | | | | | | | Suspension |
| Y2 | | | | | | | | 6 | | | | Emulsion |
| Toner | | | | | | | | | | | | Aggregation |
| M2 | | | | | | | | | 6 | | | Emulsion |
| Toner | | | | | | | | | | | | Aggregation |
| C2 | | | | | | | | | | 5 | | Emulsion |
| toner | | | | | | | | | | | | Aggregation |
| K2 | | | | | | | | | | | 5 | Emulsion |
| toner | | | | | | | | | | | | Aggregation |
| S5 | | | 15 | | | | | | | | | Dissolution |
| Toner | | | | | | | | | | | | Suspension |
| S6 | | | 10 | | | | | | | | | Dissolution |
| Toner | | | | | | | | | | | | Suspension |
| S7 | | | | 5 | | | | | | | | Dissolution |
| Toner | | | | | | | | | | | | Suspension |
| S8 | | | | 2 | | | | | | | | Dissolution |
| Toner | | | | | | | | | | | | Suspension |
| S9 | | | | | 2 | | | | | | | Dissolution |
| Toner | | | | | | | | | | | | Suspension |
| S10 | | | | | | 30 | | | | | | Dissolution |
| Toner | | | | | | | | | | | | Suspension |

The average thicknesses D of the plate-like pigments and film-like pigments used in the S1 to S10 toners are shown in Table 2.

The average thickness D was measured by the procedure described in the aforementioned section "Average Thickness D".

TABLE 2

| Product Name or Name | Water Surface Diffusion Area WCA [$cm^2/g$] | [$m^2/g$] | Average Thickness D [nm] | Remarks |
|---|---|---|---|---|
| 2173YC | 29000 | 2.9 | 138 | Available from Toyo Aluminium K.K. |
| 1200M | 23000 | 2.3 | 174 | Available from Toyo Aluminium K.K. |
| O670TS | 70000 | 7 | 57 | Available from Toyo Aluminium K.K. |
| Film-like Pigment 1 | 150000 | 15 | 27 | Prepared by vapor deposition |
| Film-like Pigment 2 | 180000 | 18 | 22 | Prepared by vapor deposition |
| TCR3130 | 15000 | 1.5 | 267 | Available from Toyo Aluminium K.K. |

Evaluations of Toners

Properties of each toner were evaluated as follows. Properties of the toners prepared in the Production Examples are shown in Table 3.

Volume Resistivity

The volume resistivity of each toner was measured as follows.

First, 3 g of a toner was molded into a pellet having a diameter of 40 mm and a thickness of about 2 mm using a presser BRE-32 (available from MAEKAWA TESTING MACHINE MFG. Co., Ltd., with a load of 6 MPa and a pressing time of 1 minute).

The pellet was set to electrodes for solid (SE-70 available from Ando Electric Co., Ltd.) and an alternating current of 1 kHz was applied to between the electrodes. At this time, Log R was measured by an alternating-current-bridge measuring instrument composed of a dielectric loss measuring instrument TR-10C, an oscillator WBG-9, and an equilibrium point detector BDA-9 (all available from Ando Electric Co., Ltd.) to determine the volume resistivity of the toner.

Volume Average Diameter (D4)

The volume average diameter (D4) was measured by a MULTISIZER III (available from Beckman Coulter, Inc.).

Average Distance H of Glittering Pigment

In a cross-section of one special-color (S) toner particle containing plate-like pigment particles as illustrated in FIG. 3A, the average value h among the shortest distances h1 and h2 between adjacent plate-like pigment particles was determined. The average value h was determined for other S toner particles in the same manner. Specifically, the average value h was determined for 20 toner particles in total, and the average of the 20 average values h was calculated as the average distance H.

Proportion of Glittering Pigment Having Deviation Angle θ of 20 Degrees or More

In a cross-section of one S toner particle containing plate-like pigment particles as illustrated in FIG. 3A, one of the plate-like pigment particles having the longest length was specified. In FIG. 3A, the plate-like pigment particle having a length of L3 was specified. Next, another one of the plate-like pigment particles forming the largest deviation angle with the above-specified plate-like pigment particle having the longest length was specified. A deviation angle θ formed between the above-specified plate-like pigment particle having the longest length and the above-specified plate-like pigment particle forming the largest deviation angle was determined. The deviation angle θ was determined for other S toner particles in the same manner. Specifically, the deviation angle θ was determined for 20 S toner particles in total.

Based on the deviation angle θ of each S toner, the proportion (% by number) of S toner particles having a deviation angle θ of 20 degrees was determined.

TABLE 3

| | Volume Resistivity [LogΩcm] | Volume Average Diameter (D4) [μm] | Average Distance H of Glittering Pigment [μm] | Proportion of Glittering Pigment Having Deviation Angle θ of 20 Degrees or More [% by number] |
|---|---|---|---|---|
| S1 Toner | 10.92 | 13.5 | 1.0 | 54 |
| S2 Toner | 10.83 | 12.4 | 0.8 | 45 |
| S3 Toner | 10.75 | 14.5 | 0.5 | 31 |
| S4 Toner | 10.60 | 13.5 | 0.3 | 18 |
| Y1 Toner | 11.09 | 5.1 | | |
| M1 Toner | 11.10 | 5.2 | | |
| C1 toner | 11.12 | 5.3 | | |
| K1 toner | 11.07 | 5.2 | | |
| Y2 Toner | 11.01 | 4.9 | | |
| M2 Toner | 10.94 | 5.0 | | |
| C2 toner | 11.01 | 4.8 | | |
| K2 toner | 10.91 | 5.1 | | |
| S5 Toner | 10.87 | 12.9 | 0.6 | 56 |
| S6 Toner | 10.96 | 12.3 | 0.7 | 54 |
| S7 Toner | 10.83 | 11.9 | — | — |

TABLE 3-continued

| | Volume Resistivity [LogΩcm] | Volume Average Diameter (D4) [μm] | Average Distance H of Glittering Pigment [μm] | Proportion of Glittering Pigment Having Deviation Angle θ of 20 Degrees or More [% by number] |
|---|---|---|---|---|
| S8 Toner | 11.01 | 10.6 | — | — |
| S9 Toner | 11.03 | 9.8 | — | — |
| S10 Toner | 10.51 | 13.9 | 0.4 | 22 |

Example 1

An image forming apparatus for evaluation in Example 1 was prepared by incorporating the S1 toner, Y1 toner, M1 toner, C1 toner, and K1 toner into a color production printer RICOH PRO C7200S (available from Ricoh Co., Ltd.).

RICOH PRO C7200S has the same configuration as the image forming apparatus illustrated in FIG. 1 and sequentially forms, from the surface side of a coated paper sheet, a K1 toner image layer, a C1 toner image layer, an M1 toner image layer, a Y1 toner image layer, and an S1 toner image layer. The primary transfer and the secondary transfer were conducted under conditions optimized for the Y1 toner, M1 toner, C1 toner, K1 toner, and a coated paper sheet (POD GLOSS COATED PAPER available from Oji Paper Co., Ltd.).

Evaluation of Image Forming Apparatus

Transfer Rate

Under the condition for outputting five color toners in an overlapping manner, solid images of the S1 toner, in a rectangular shape with a side of 1 cm (in the direction of travel) and another side of 20 cm, were continuously formed at intervals of 4 cm on a coated paper sheet, and the rate of transfer onto the coated paper sheet was evaluated. During image formation, the operation of the image forming apparatus was stopped, and the amount of the S1 toner adhered to the intermediate transfer belt 131 between the primary transfer rollers 134S and 134Y was measured. The deposition amount of the S1 toner on the coated paper sheet was measured before the sheet had entered the fixing device 14 to determine the transfer rate. The deposition amount was determined by sucking the toner in the solid image portion by a suction device equipped with a filter and measuring an increased weight.

The transfer rate in Example 1 was 92%. The results are shown in Table 5. Here, 8% of the toner, which has not been transferred, includes that reversely transferred in the primary transfer portion and that remaining on the intermediate transfer belt 134 in the second transfer portion.

Character Sharpness

Image quality was evaluated by characters printed with the S1 toner. Solid images of Y, M, C, and K were also printed together with the characters printed with S1 toner. Specifically, using the image forming apparatus illustrated in FIG. 1, a K1 toner solid image, a C1 toner solid image, an M1 toner solid image, and a Y1 toner solid image were sequentially formed from the surface side of a coated paper sheet, and characters were further formed thereon with S1 toner. The K1 toner, C1 toner, M1 toner, and Y1 toner were overlapped to form a black image. Since the deposition amount of these toners was large and Y, M, and C colors were overlapped, a deep black image was formed. It was visually recognized that silver characters were printed on a solid black background. The sharpness of the characters was ranked according to the following evaluation criteria.

The evaluation rank was 5 in Example 1. The results are shown in Table 5.

Evaluation Criteria

Evaluation rank 1: The characters cannot be read.

Evaluation rank 2: Unsharp.

Evaluation rank 3: Slightly unsharp.

Evaluation rank 4: The characters are slightly blurred.

Evaluation rank 5: Sharp.

Glittering Property

Under the condition for outputting five color toners in an overlapping manner, solid images of the S1 toner, in a rectangular shape with a side of 1 cm (in the direction of travel) and another side of 20 cm, were continuously formed at intervals of 4 cm on a coated paper sheet.

The degree of reflection of each image sample at the angle at which the reflected light became the highest under ordinary lighting in the office room were evaluated into 5 ranks as follows. The results are shown in Table 5. Among the image samples formed at different temperatures, the one with the highest evaluation result was used as a representative sample.

Evaluation Criteria

Rank 1: Reflectivity is the same level as that of the coated paper sheet alone.

Rank 2: The amount of reflected light is changed little even when the angle is changed.

Rank 3: As the angle is changed, there is a reflective region where the amount of reflected light is increased in one direction.

Rank 4: As the angle is changed, there is a large reflective region in one direction.

Rank 5: As the angle is changed, there is a very large region in one direction.

Flop Index (FI)

To evaluate glittering property, the flop index (FI) was measured. The larger the FI of an image, the higher the glittering feeling of the image. The measurements of L15, L45, and L110 was performed by a multi-angle spectrocolorimeter BYK-mac (available from BYK-Gardner), and the FI was calculated by the following formula. The results are shown in Table 5.

$$FI=2.69\times(L15-L110)^{1.11}/L45^{0.86}$$

Examples 2 to 15 and Comparative Examples 1 to 5

The procedure in Example 1 was repeated except for changing the combination of toners according to the descriptions in Tables 4-1 to 4-4 to prepare image forming apparatuses for evaluation in Examples 2 to 15 and Comparative Examples 1 to 5. The results are shown in Table 5.

The differences in volume resistivity between the special-color toner and the other color toners in each combination of Examples 1 to 15 and Comparative Examples 1 to 5 are shown together in Tables 4-1 to 4-4.

In Examples 3, 4, 5, 11, 12, 13, 14, and 15 and Comparative Examples 3 and 5, the primary transfer and the secondary transfer were conducted under conditions optimized for the Y2 toner, M2 toner, C2 toner, K2 toner, and a coated paper sheet (POD GLOSS COATED PAPER available from Oji Paper Co., Ltd.).

TABLE 4-1

| | Log R | Example 1 S1 Toner 10.92 | Example 2 S2 Toner 10.83 | Comparative Example 1 S3 Toner 10.75 | Comparative Example 2 S4 Toner 10.60 | Example 6 S5 Toner 10.87 |
|---|---|---|---|---|---|---|
| Y1 Toner | 11.09 | 0.17 | 0.26 | 0.34 | 0.49 | 0.22 |
| M1 Toner | 11.10 | 0.18 | 0.27 | 0.35 | 0.50 | 0.23 |
| C1 toner | 11.12 | 0.20 | 0.29 | 0.37 | 0.52 | 0.25 |
| K1 toner | 11.07 | 0.15 | 0.24 | 0.32 | 0.47 | 0.20 |

Difference in Volume Resistivity [LogΩcm]

TABLE 4-2

| | Log R | Example 7 S6 Toner 10.96 | Example 8 S7 Toner 10.83 | Example 9 S8 Toner 11.01 | Example 10 S9 Toner 11.03 | Comparative Example 4 S10 Toner 10.51 |
|---|---|---|---|---|---|---|
| Y1 Toner | 11.09 | 0.13 | 0.26 | 0.08 | 0.06 | 0.58 |
| M1 Toner | 11.10 | 0.14 | 0.27 | 0.09 | 0.07 | 0.59 |
| C1 toner | 11.12 | 0.16 | 0.29 | 0.11 | 0.09 | 0.61 |
| K1 toner | 11.07 | 0.11 | 0.24 | 0.06 | 0.04 | 0.56 |

Difference in Volume Resistivity [LogΩcm]

TABLE 4-3

| | Log R | Example 3 S1 Toner 10.92 | Example 4 S2 Toner 10.83 | Example 5 S3 Toner 10.75 | Comparative Example 3 S4 Toner 10.60 | Example 11 S5 Toner 10.87 |
|---|---|---|---|---|---|---|
| Y2 Toner | 11.01 | 0.09 | 0.18 | 0.26 | 0.41 | 0.14 |
| M2 Toner | 10.94 | 0.02 | 0.11 | 0.19 | 0.34 | 0.07 |
| C2 toner | 11.01 | 0.09 | 0.18 | 0.26 | 0.41 | 0.14 |
| K2 toner | 10.91 | −0.01 | 0.08 | 0.16 | 0.31 | 0.04 |

Difference in Volume Resistivity [LogΩcm]

TABLE 4-4

| | Log R | Example 12 S6 Toner 10.96 | Example 13 S7 Toner 10.83 | Example 14 S8 Toner 11.01 | Example 15 S9 Toner 11.03 | Comparative Example 5 S10 Toner 10.51 |
|---|---|---|---|---|---|---|
| Y2 Toner | 11.01 | 0.05 | 0.18 | 0.00 | −0.02 | 0.50 |
| M2 Toner | 10.94 | −0.02 | 0.11 | −0.07 | −0.09 | 0.43 |
| C2 toner | 11.01 | 0.05 | 0.18 | 0.00 | −0.02 | 0.50 |
| K2 toner | 10.91 | −0.05 | 0.08 | −0.10 | −0.12 | 0.40 |

Difference in Volume Resistivity [LogΩcm]

TABLE 5

| | Transfer Rate [%] | Character Sharpness Ranks | Glittering Property Ranks | Flop Index (FI) |
|---|---|---|---|---|
| Example 1 | 92 | 5 | 5 | 8.9 |
| Example 2 | 89 | 4 | 4 | 7.3 |
| Example 3 | 93 | 5 | 5 | 9.1 |
| Example 4 | 91 | 5 | 5 | 8.9 |
| Example 5 | 90 | 4 | 4 | 7.4 |
| Comparative Example 1 | 67 | 2 | 2 | 3.6 |
| Comparative Example 2 | 79 | 3 | 3 | 5.5 |
| Comparative Example 3 | 69 | 2 | 3 | 3.8 |
| Example 6 | 90 | 4 | 5 | 9.8 |
| Example 7 | 93 | 5 | 5 | 9.5 |
| Example 8 | 89 | 4 | 5 | 12.6 |
| Example 9 | 94 | 5 | 5 | 11.5 |
| Example 10 | 95 | 5 | 5 | 12.0 |
| Example 11 | 91 | 5 | 5 | 9.9 |
| Example 12 | 95 | 5 | 5 | 9.3 |
| Example 13 | 90 | 5 | 5 | 12.3 |
| Example 14 | 93 | 5 | 5 | 11.4 |
| Example 15 | 92 | 5 | 5 | 11.9 |
| Comparative Example 4 | 63 | 2 | 2 | 3.5 |
| Comparative Example 5 | 71 | 2 | 3 | 4.1 |

According to some embodiments of the present invention, a high-definition high-quality image can be produced at a high transfer rate of special-color toner, by bringing the volume resistivity of the special-color toner having glittering property close to that of a colored toner, while securing glittering property of the image.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus comprising:

a first electrostatic latent image bearer configured to bear a colored toner image;

a first electrostatic latent image forming device configured to form a first electrostatic latent image on the first electrostatic latent image bearer;

a first developing device containing a colored toner, configured to develop the first electrostatic latent image formed on the first electrostatic latent image bearer with the colored toner to form the colored toner image;

a second electrostatic latent image bearer configured to bear a special-color toner image;

a second electrostatic latent image forming device configured to form a second electrostatic latent image on the second electrostatic latent image bearer;

a second developing device containing a special-color toner, configured to develop the second electrostatic latent image formed on the second electrostatic latent image bearer with the special-color toner to form the special-color toner image;

a primary transfer device configured to transfer the colored toner image and the special-color toner image onto a surface of an intermediate image bearer in an overlapping manner to form a composite toner image;

a secondary transfer device configured to transfer the composite toner image from the intermediate image bearer onto a surface of a recording medium; and a fixing device configured to fix the composite toner image on the surface of the recording medium, wherein the colored toner comprises a carbon black, wherein the special-color toner comprises a metallic pigment, and wherein an absolute difference in volume resistivity between the special-color toner and the colored toner is 0.30 log Ω cm or less.

2. The image forming apparatus according to claim 1, wherein the absolute difference in volume resistivity between the special-color toner and the colored toner is 0.20 log Ω cm or less.

3. The image forming apparatus according to claim 1, wherein the metallic pigment has an average thickness of from 15 to 300 nm.

4. The image forming apparatus according to claim 3, wherein the metallic pigment has an average thickness of from 25 to 100 nm.

5. The image forming apparatus according to claim 1, wherein, in a cross-section of the special-color toner, an average distance H between adjacent particles among multiple particles of the metallic pigment is 0.5 μm or more.

6. The image forming apparatus according to claim 1, wherein, in a cross-section of the special-color toner, 30% by number or more of multiple particles of the special-color toner have a deviation angle of 20 degrees or more, where the deviation angle is an angle formed between a first particle of the metallic pigment having a longest length in one toner particle and a second particle of the metallic pigment forming a largest angle with the first particle in the one toner particle.

7. The image forming apparatus according to claim 1, wherein a proportion of metal in the special-color toner is 50% by mass or more.

8. The image forming apparatus according to claim 1, wherein a volume resistivity of the special-color toner is in a range from 10.5 log Ω cm to 11.5 log Ω cm.

9. A toner set comprising:

a colored toner comprising a carbon black; and a special-color toner comprising a metallic pigment, wherein an absolute difference in volume resistivity between the special-color toner and the colored toner is 0.30 log Ω cm or less.

10. The toner set according to claim 9, wherein the absolute difference in volume resistivity between the special-color toner and the colored toner is 0.20 log Ω cm or less.

11. The toner set according to claim 9, wherein the metallic pigment has an average thickness of from 15 to 300 nm.

12. The toner set according to claim 11, wherein the metallic pigment has an average thickness of from 25 to 100 nm.

13. The toner set according to claim 9, wherein, in a cross-section of the special-color toner, an average distance H between adjacent particles among multiple particles of the metallic pigment is 0.5 μm or more.

14. The toner set according to claim 9, wherein, in a cross-section of the special-color toner, 30% by number or more of multiple particles of the special-color toner have a deviation angle of 20 degrees or more, where the deviation angle is an angle formed between a first particle of the metallic pigment having a longest length in one toner particle and a second particle of the metallic pigment forming a largest angle with the first particle in the one toner particle.

15. The toner set according to claim 9, wherein a proportion of metal in the special-color toner is 50% by mass or more.

16. The toner set according to claim 9, wherein a volume resistivity of the special-color toner is in a range from 10.5 log Ω cm to 11.5 log Ω cm.

* * * * *